US010954762B2

(12) United States Patent
Patel

(10) Patent No.: US 10,954,762 B2
(45) Date of Patent: Mar. 23, 2021

(54) COMPLETION ASSEMBLY

(71) Applicant: SCHLUMBERGER TECHNOLOGY CORPORATION, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 16 days.

(21) Appl. No.: 15/702,850

(22) Filed: Sep. 13, 2017

(65) Prior Publication Data

US 2018/0073335 A1 Mar. 15, 2018

Related U.S. Application Data

(60) Provisional application No. 62/394,084, filed on Sep. 13, 2016, provisional application No. 62/394,069, filed on Sep. 13, 2016, provisional application No. 62/400,439, filed on Sep. 27, 2016, provisional application No. 62/403,297, filed on Oct. 3, 2016, provisional application No. 62/432,040, filed on Dec. 9, 2016.

(51) Int. Cl.
*E21B 43/12* (2006.01)
*E21B 34/10* (2006.01)
(Continued)

(52) U.S. Cl.
CPC ..... *E21B 43/12* (2013.01); *E21B 23/02* (2013.01); *E21B 33/1285* (2013.01);
(Continued)

(58) Field of Classification Search
CPC ..... E21B 23/02; E21B 33/1285; E21B 34/10; E21B 34/14; E21B 43/08; E21B 43/12; E21B 47/12
See application file for complete search history.

(56) References Cited

U.S. PATENT DOCUMENTS 6,085,845 A 7/2000 Patel et al.
8,347,958 B2 1/2013 Hartog et al.
(Continued)

FOREIGN PATENT DOCUMENTS

WO WO-2015084455 A1 * 6/2015 ..... E21B 43/08

OTHER PUBLICATIONS

"eFire-TCP Firing Head Enaled by Muzic Telemetry", Schlumberger Product Brochure, 2016, 2 pages.
"SFIV-II", Schlumberger Product Brochure, 2014, 2 pages.

*Primary Examiner* — Caroline N Butcher
(74) *Attorney, Agent, or Firm* — Kelly McKinney

(57) ABSTRACT

A completion assembly includes tubing that defines an axis that extends from a distal shoe end to a proximal uphole end where the tubing includes: a washdown shoe; a plug seat configured to receive a plug that hinders flow through the washdown shoe; a screen; a fluid loss control device that permits, in an exterior space, flow of fluid in an uphole direction and that hinders flow of fluid in a downhole direction; a circulation valve that is actuatable to permit flow of fluid from an interior space to the exterior space; a formation isolation valve that is actuatable to form a flow barrier in the interior space; a packer that is actuatable to extend radially outwardly from the tubing to form an annular flow barrier in the exterior space; and a barrier component that is actuatable to form a flow barrier in the interior space of the tubing.

19 Claims, 26 Drawing Sheets

(51) Int. Cl.

| | |
|---|---|
| ***E21B 43/08*** | (2006.01) |
| ***E21B 33/128*** | (2006.01) |
| ***E21B 47/12*** | (2012.01) |
| ***E21B 23/02*** | (2006.01) |
| ***E21B 34/14*** | (2006.01) |

(52) U.S. Cl.
CPC ..... *E21B 34/10* (2013.01); *E21B 34/14* (2013.01); *E21B 43/08* (2013.01); *E21B 47/12* (2013.01)

(56) References Cited

U.S. PATENT DOCUMENTS

| | | | | |
|---|---|---|---|---|
| 8,347,968 | B2 | 1/2013 | Debard et al. | |
| 8,950,503 | B2 | 2/2015 | Purkis | |
| 8,978,757 | B2 | 3/2015 | Wang et al. | |
| 9,739,113 | B2 | 8/2017 | Patel | |
| 10,316,626 | B2 | 6/2019 | Keshishian et al. | |
| 2002/0112862 | A1* | 8/2002 | Patel | E21B 23/006 166/386 |
| 2009/0211769 | A1* | 8/2009 | Assal | E21B 33/124 166/387 |
| 2010/0096134 | A1 | 4/2010 | Barlow et al. | |
| 2010/0175894 | A1* | 7/2010 | Debard | E21B 34/10 166/382 |
| 2011/0056679 | A1 | 3/2011 | Rytlewski | |
| 2013/0306316 | A1* | 11/2013 | Patel | E21B 17/02 166/299 |
| 2014/0008085 | A1* | 1/2014 | Tinnen | E21B 29/00 166/387 |
| 2014/0209327 | A1* | 7/2014 | Patel | E21B 43/12 166/387 |
| 2016/0183405 | A1 | 6/2016 | Sanada et al. | |

* cited by examiner

COMPLETION ASSEMBLY

RELATED APPLICATIONS

This application claims priority to and the benefit of: a U.S. provisional application having Ser. No. 62/394,084, filed Sep. 13, 2016, which is incorporated by reference herein; a U.S. provisional application having Ser. No. 62/394,069, filed Sep. 13, 2016, which is incorporated by reference herein; a U.S. provisional application having Ser. No. 62/400,439, filed Sep. 27, 2016, which is incorporated by reference herein; a U.S. provisional application having Ser. No. 62/403,297, filed Oct. 3, 2016, which is incorporated by reference herein; and a U.S. provisional application having Ser. No. 62/432,040, filed Dec. 9, 2016.

BACKGROUND

For purposes of forming a well to extract a hydrocarbon based fluid (oil or natural gas) from a subterranean, hydrocarbon-bearing geologic formation, or to inject water into or around a subterranean, geologic formation, for example, among one or more other purposes, a bore can be drilled into the formation. In such an example, completion (e.g., a system of tubes, valves to regulate flow of fluid, etc.) may be installed in to a bore. In various instances, two or more runs, or trips, into the bore may be utilized for installing completion equipment. For example, a first run may involve running a lower completion to a distal portion of a bore. At a subsequent time, an upper completion may be run into the bore, for example, to provide tubing, mechanisms, etc., for example, to connect the lower completion to a hydrocarbon removal point or wellhead location. In field operations, each trip into a bore adds to cost and complexity of completing a well.

SUMMARY

A method can include running a completion system in a borehole where the completion system includes a screen, a packer and a fluid loss control device uphole of the screen and downhole of the packer; flowing fluid via a washdown shoe of the completion system; deploying a plug to a plug seat to hinder flow through the washdown shoe; opening a circulation valve; setting the packer via fluid pressure communicated through the circulation valve to an annulus formed in part by the completion system where the packer establishes a barrier to fluid flow in the annulus; closing a formation isolation valve to establish a first barrier to fluid flow in a bore of the completion system; and actuating a barrier component to establish a second barrier to fluid flow in the bore of the completion system. A completion assembly can include tubing that defines an axis that extends from a distal shoe end to a proximal uphole end where the tubing includes: a washdown shoe that permits flow from an interior space defined by the tubing to an exterior space; a plug seat configured to receive a plug that hinders flow through the washdown shoe; a screen that permits flow from the exterior space to the interior space; a fluid loss control device that permits, in the exterior space, flow of fluid in an uphole direction and that hinders flow of fluid in a downhole direction; a circulation valve that is actuatable to permit flow of fluid from the interior space to the exterior space; a formation isolation valve that is actuatable to form a flow barrier in the interior space; a packer that is actuatable to extend radially outwardly from the tubing to form an annular flow barrier in the exterior space; and a barrier component that is actuatable to form a flow barrier in the interior space of the tubing. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
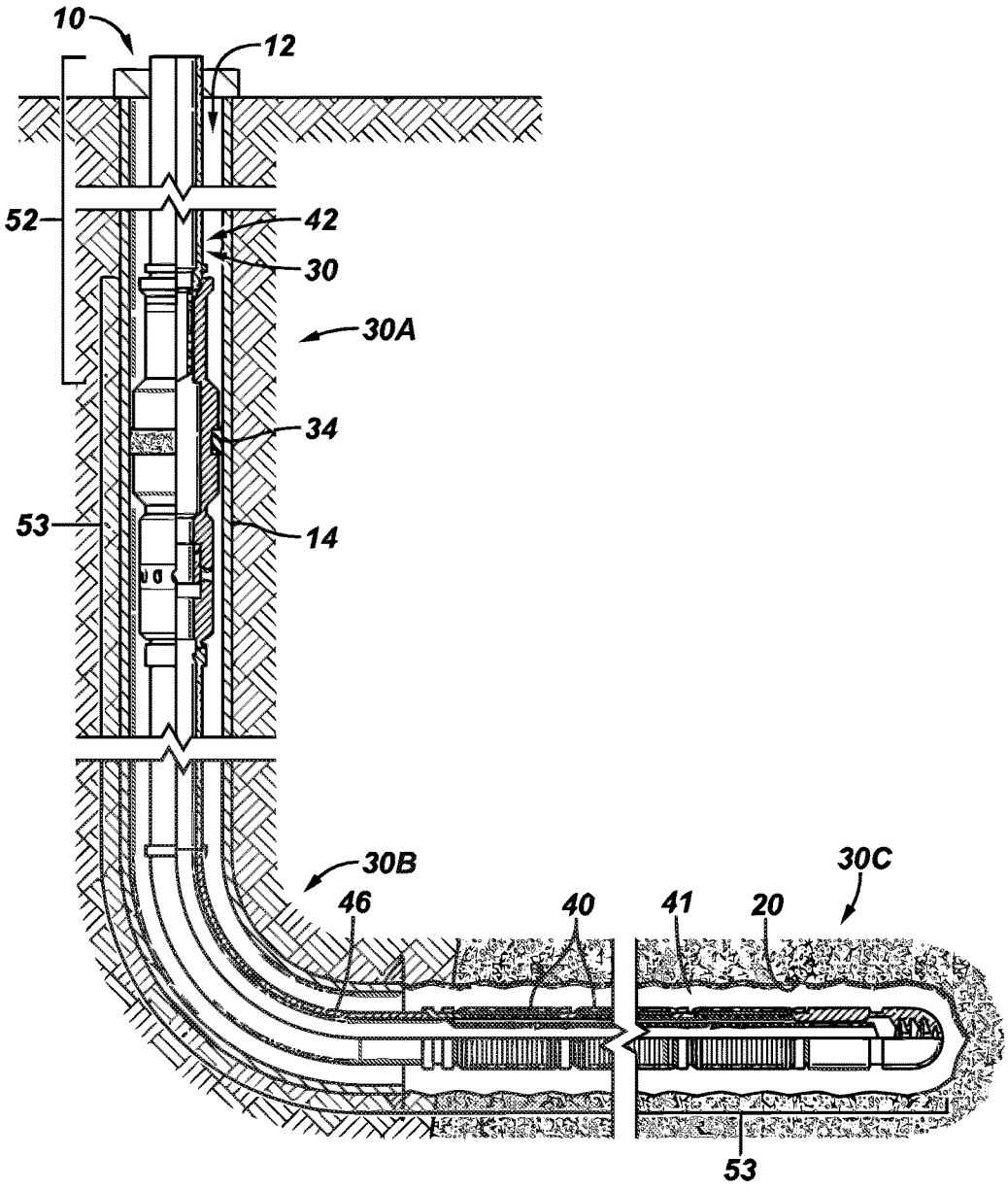
FIG. 1 illustrates examples of equipment in an environment.

FIG. 1 shows an example of a well 10, which includes at least one wellbore 12 that extends through one or more formations that contain a hydrocarbon-based fluid. For the example depicted in FIG. 1, the wellbore 12 includes a first segment that is cased by a casing string 14 and a lateral, uncased open hole segment 20. As an example, a well may have more than one lateral segment. Various systems, assemblies, techniques, etc. may be applied to land wells, subsea wells, etc., which can include one or more vertical portions and/or one or more deviated portions, which may include one or more lateral portions (e.g., one or more substantially horizontal portions).

In the example of FIG. 1, the well 10 includes disposed therein a single trip completion system 30, which may be installed via appropriate equipment (e.g., rig equipment, etc.). As shown, the single trip completion system 30 is part of a tubular string 42 with appropriate upper completion equipment (not shown), which extends to the surface of the well 10 and hangs from a tubing hanger (TH) provided at its upper end. As depicted in FIG. 1 for this example, the single trip completion system 30 is disposed at an end of the string 42, which may be referred to as a distal end, with reference to the well head at the surface being a proximal end. A well may be defined by an axis, which, as mentioned, may be vertical and/or deviated. Axial and/or radial coordinates may be utilized to define one or more components, one or more techniques, etc. As an example, a cylindrical coordinate system may be utilized to define one or more components, one or more techniques, etc. (e.g., consider an axial coordinate, a radial coordinate and an azimuthal coordinate).

The single trip completion system 30 can be installed using a single trip into the well 10, for example, for purposes of installing an upper completion and a lower completion, which are approximately identified in FIG. 1 as an upper section 52 (e.g., or upper portion, upper completion, proximal section, etc.) and a lower section 53 (e.g., or lower portion, lower completion, distal section, etc.), respectively, of the single trip completion system 30 (STCS 30). In the example of FIG. 1, the STCS 30 can be run downhole as a single unit using a single trip into the well 10.

The upper section 52 and the lower 53 section are sealed to each other, and are mechanically and optionally releasably connected to each other through an optionally provided, selectably releasable anchor latch. The seal between the upper and lower sections 52 and 53 may be formed using a polished bore receptacle (PBR) that is located at an upper end of the lower section 53. In this regard the upper section 52 may have an extension at its lower end, which is designed to reside within and seal to the PBR. As an example, the extension may include sealing rings (e.g., O-rings, etc.) for purposes of forming a seal between the upper section 52 and the lower section 53.

The lower section 53 of the single trip completion system 30 may include screens 40, which are concentrated together and extend into the uncased, open hole segment 20 of the wellbore 12. In other examples, the screens 40 may extend inside of the casing if the well were entirely cased. The screens 40 may be located near the lower end of the lower section 53 and communicate well fluid from an annular region 41 (e.g., an annulus) that surrounds the screens 40 into a central passageway of the system 30 (and string 42).

The single trip completion system 30 may form an annular seal between the exterior of the STCS 30 and the interior surface of the casing string 14 through the setting of a packer 34, which is part of the lower section and is disposed near the upper end of the lower section 53. Due to this arrangement, produced well fluid is directed to flow through the screens 40, into the STCS 30 and thus, into the string 42 to the surface of the well 10.

As an example, the packer 34 may a hydraulically-set packer. Alternatively, the packer 34 may be another type of packer (a weight set or swellable packer, for example) that is set by another mechanism.

For the example in which the packer 34 is a hydraulically-set packer, the packer 34 may be set using the internal tubing pressure that is conveyed downhole through the central passageway of the string 42 (and single trip completion system 30). In this regard, the STSC 30 may include a washdown shoe at its lower end, which may be configured to accept at least one plug (e.g., a ball, etc.). The plug(s) may seal off the internal passageway of the single trip completion system 30 at axial locations below the packer 34. The sealing of the internal passageway of the system 30 allows for a build-up or increase in pressure, which may be utilized to set the packer 34.

As an example, a washdown shoe may contain a ball seat that accepts a ball plug that is deployed (e.g., dropped and/or pumped) from the surface of a well. One or more other types of valves may be used for purposes of creating a sealed volume in the central passageway of the STSC 30 for purposes of actuating the packer 34, in accordance with other variations. For example, one or more formation isolation valves (FIV) (not shown) may be used to reversibly seal and/or to prevent communication between one portion of the internal passageway of the STSC 30 and another portion of the internal passageway.

For purposes of releasing the packer 34, the packer 34 may be configured as a straight pull release packer, as a non-limiting example. Accordingly, in the case of a well control situation in which the packer 34 had a set off depth and was afterwards released, the straight pull release permits the releasing of the packer 34 and the pulling of the entire completion in the same trip.

As an example, the packer 34 may be a multiple port packer. A multiple port packer may allow for multiple feedthroughs for control lines and/or communication cables (e.g., electrical cables, optical cables, etc.) to extend in the annulus between portions of the STSC 30 separated by the packer 34. The packer 34 may be V0 rated and may have a cut to release mechanism for tensile pulling of the packer 34. One or more other variations may optionally be utilized, for example, consider a variation where the packer 34 may alternatively be mechanically set or set via a control line. For subsea wells, as an example, a remotely operated vehicle (ROV) may be used to set the packer 34 using the control line if necessary.

The packer 34 of FIG. 1 is an example of one of a number of potential components of the single trip completion system 30, which facilitate the cleanup of the well and well displacement.

As an example, the single trip completion system 30 may include one or more features that permit detachment and separation of the upper section 52 from the lower section 53.

As an example, the single trip completion system 30 may be compatible with various mud systems, may be deployable in deepwater environments, subsea environments and/or terrestrial well systems.

The single trip completion system 30 may be compatible with various types of completion components. In some cases, the single trip completion system 30 may provide for water injection or other forms of well operation alternatively or in addition to hydro-carbon production.

As shown in the example of FIG. 1, components of the single trip completion system 30 may include, as a non-limiting list of examples, a packer, a washdown shoe system, lateral check valve system, pressure actuated sliding sleeves, electronic trigger actuation mechanisms, annular flow control valves, isolation valves, formation isolation valves, safety valves, sensors, screens, a releasable anchor latch, etc.

FIGS. 2A, 2B, 3A, 3B, 4A, 4B, 5A and 5B illustrate examples of equipment with respect to the well 10 where the equipment includes the single trip completion system 30.

Figure 2A:
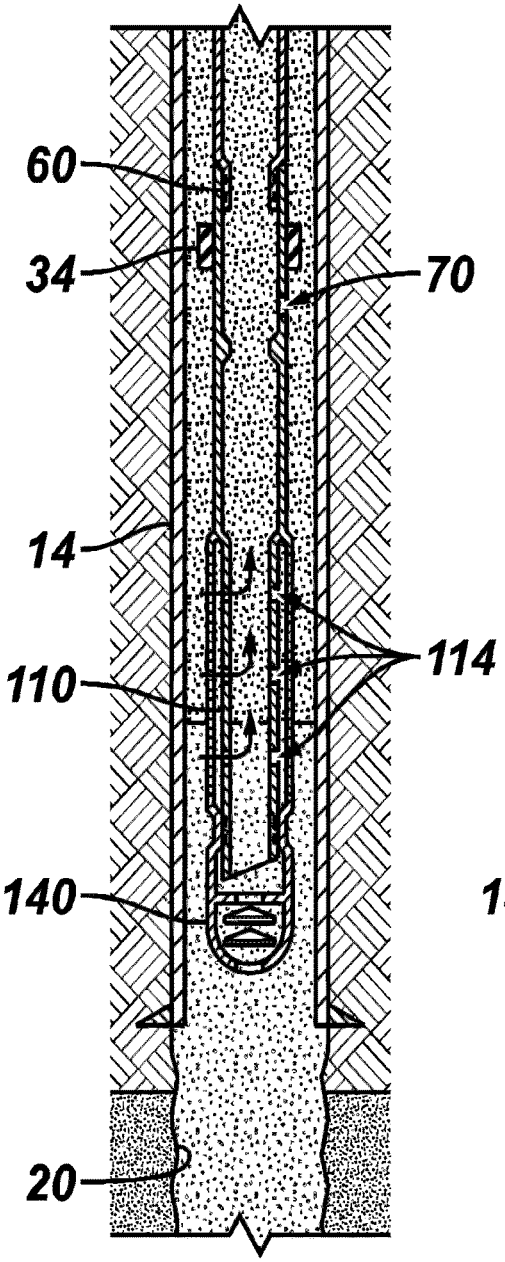
FIGS. 2A and 2B illustrate examples of equipment as part of an example of a workflow.

Referring to FIG. 2A, initially, flow control devices 114 may be opened in the run-in-hole (RIH) state of the STCS 30 so that the lower portion of the lower section 53 fills with the fluid in the well 10. Also during this state, an annular valve 70 may be open.

Figure 2B:
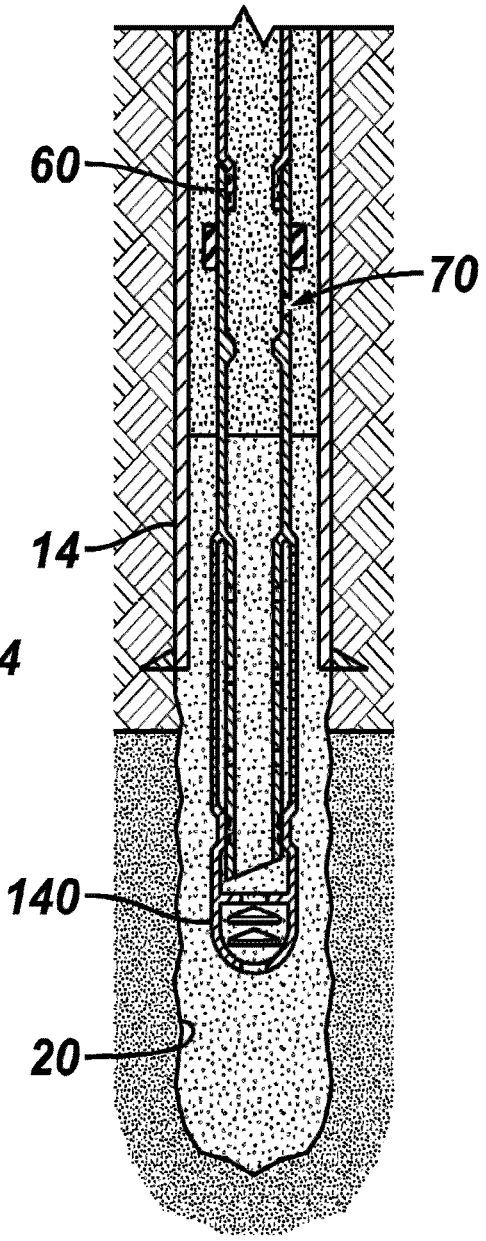

Referring to FIG. 2B, if washdown is desired, the annular valve 70 may be closed, and the washdown may occur with a cleaning fluid (e.g., a cleaning fluid such as hydroxyethyl cellulose (HEC)) as may have been previously placed inside the inner string volume and cleaning fluid that was auto filled from the volume left at the bottom of the casing, as shown in connection with FIG. 2A. Rates may be maintained below a maximum level acceptable prior to swabbing packer elements and may depend on casing/packer size and type.

Figure 3A:
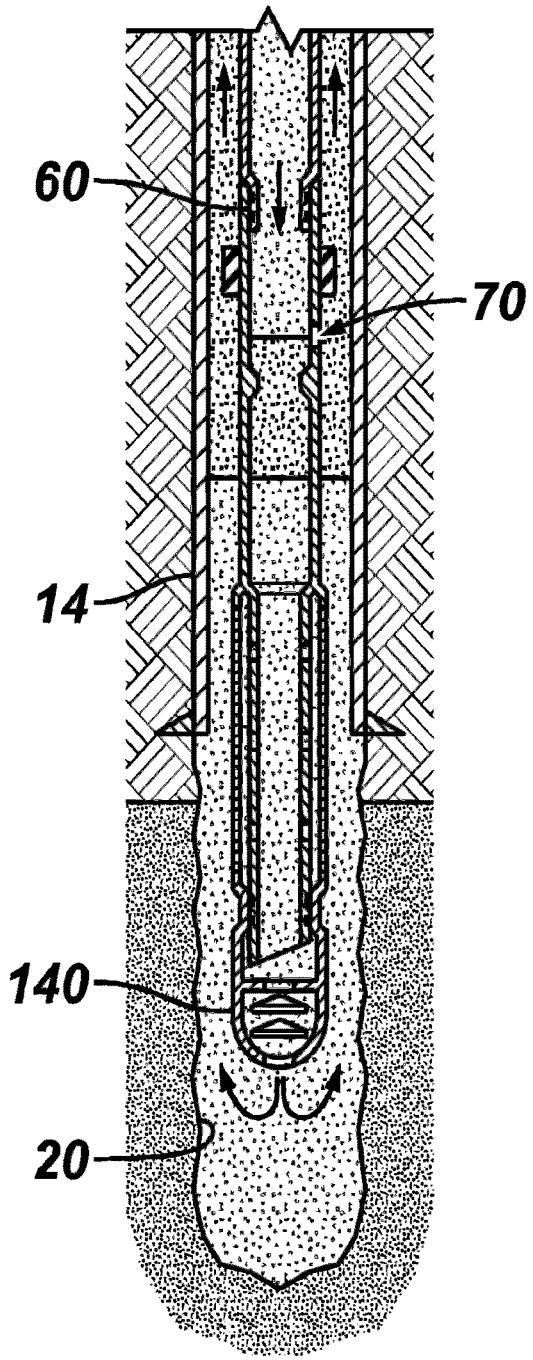
FIGS. 3A and 3B illustrate examples of equipment as part of an example of a workflow.
Figure 3B:
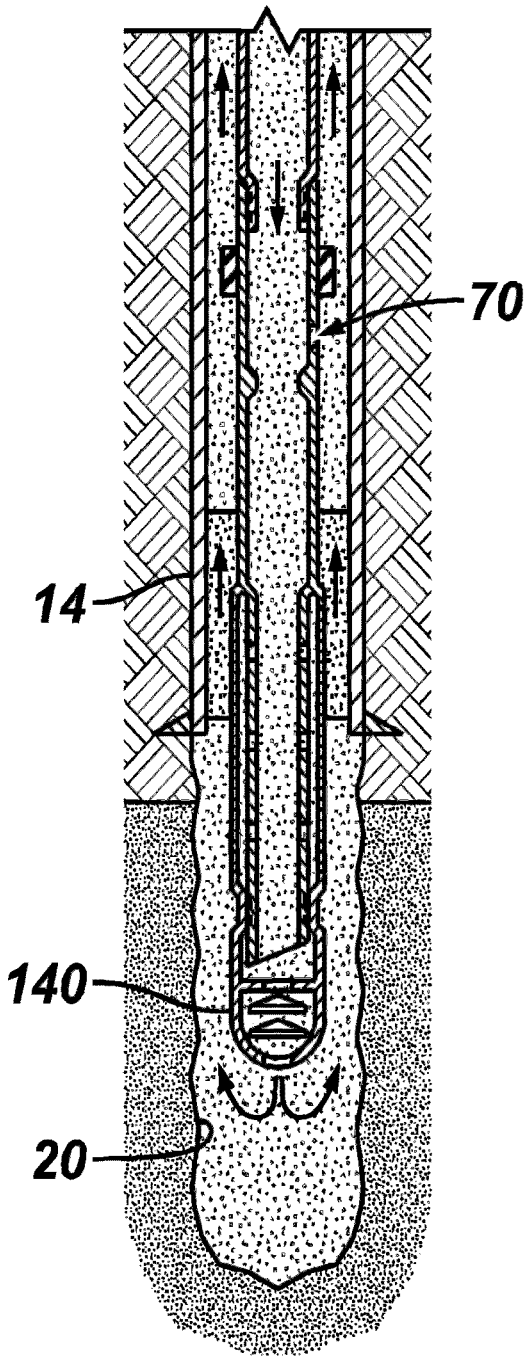

Referring to FIG. 3A, if the volume of cleaning fluid contained within the tubing is not expected to be enough, an operator may stop circulating when the level of the cleaning fluid (e.g., with shale inhibitor, etc.) is at the depth of the annular valve 70, as depicted in FIG. 3A. More specifically, at this point, a new pill of cleaning fluid may be circulated through the annular valve 70 in an open state until it reaches the annular valve depth, as depicted in FIG. 3A. The annular valve 70 may then be closed and washing down may continue, as depicted in FIG. 3B.

Figure 4A:
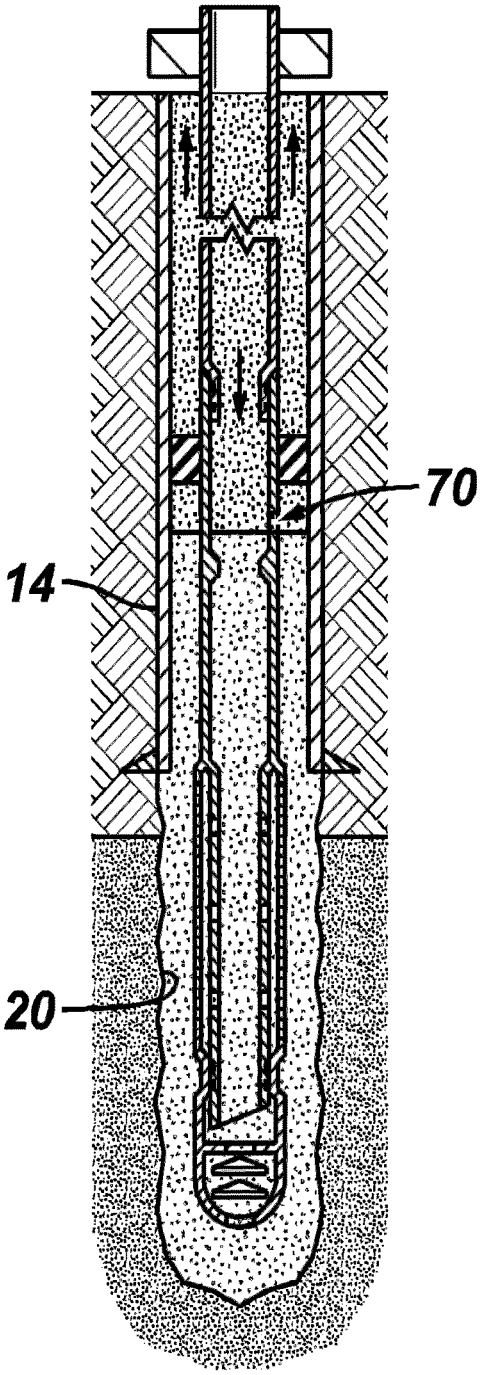
FIGS. 4A and 4B illustrate examples of equipment as part of an example of a workflow.

Referring to FIG. 4A, once the cleaning fluid is close to the bottom, the annular valve 70 may be opened. If desired, the filtercake treatment may be displaced to the top of the annular valve 70. In addition, as an example, the annular valve 70 may be closed (e.g., in a closed state), and the filtercake treatment may be pumped down and through the washdown shoe 140 and up the annulus of the open hole of the well 10. In such an example, the annular valve 70 may then be reopened.

As an example, a high viscosity pill may be circulated at an appropriate rate from an annular port alongside the casing 14, proceeding up the annulus. Once the high viscosity pill has passed the packer restriction, the rate may be increased in order to lift debris. As an example, a brine rate along the packer may be controlled to prevent swabbing of the packer element. As an example, pumped brine may include a proper oxygen scavenger component and corrosion inhibitor, for example, to be used as an adequate packer fluid.

Figure 4B:
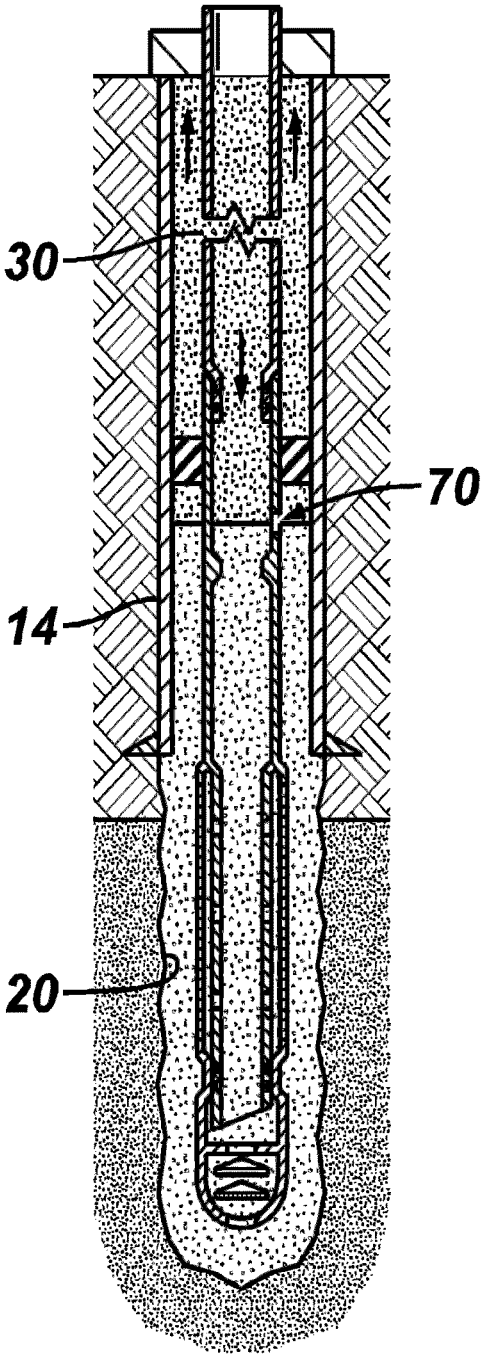

Referring to FIG. 4B, the tubing hanger (TH) landing sequence may be initiated after the remaining debris is removed or washed away from the packer setting depth and from the tubing hanger landing seat.

Figure 5A:
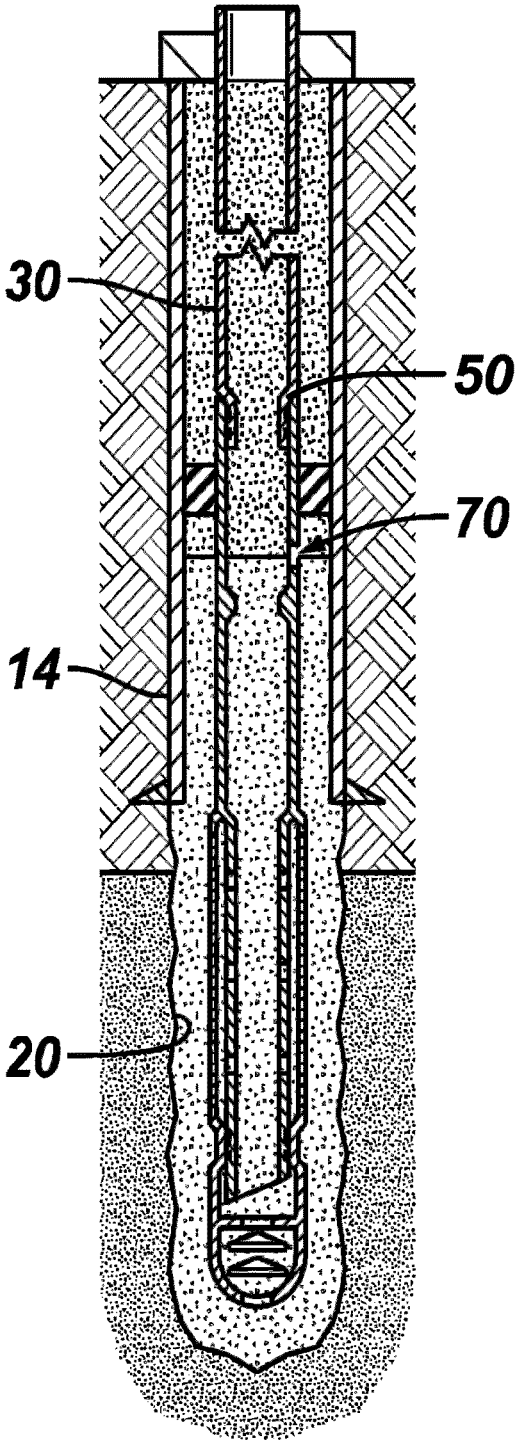
FIGS. 5A and 5B illustrate examples of equipment as part of an example of a workflow.
Figure 5B:
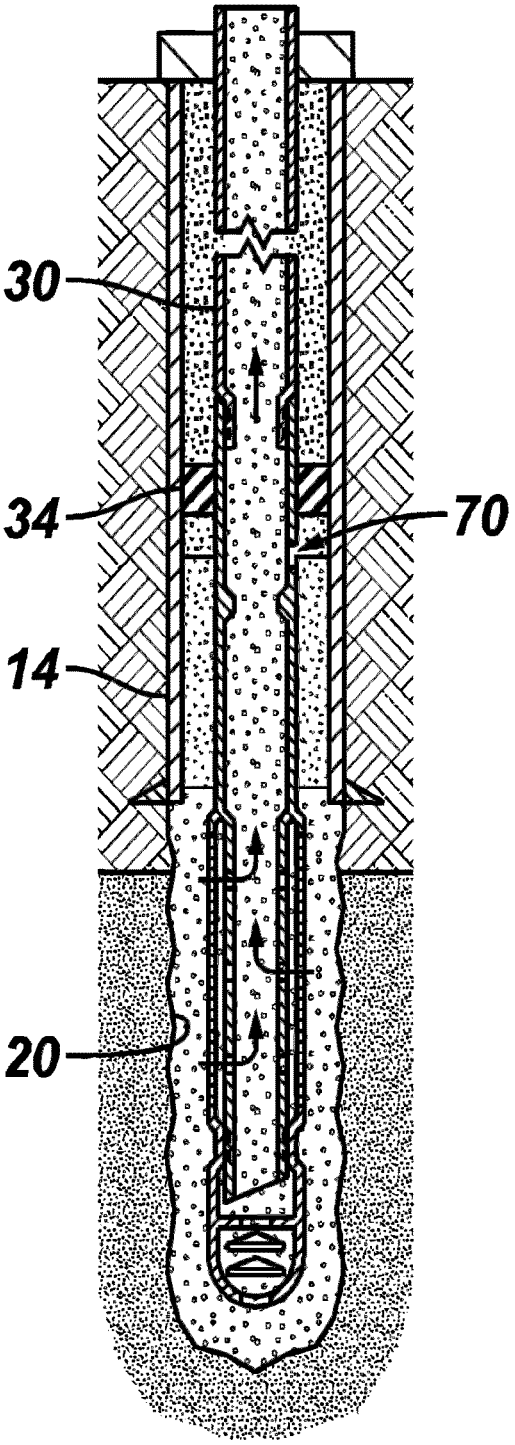

Referring to FIG. 5A, once the tubing hanger is landed, the annular valve 70 may be closed. As an example, pressure may be applied to a control line to set the packer 34 (see FIG. 5B). A hydraulic release mechanism of a hydraulic release anchor latch 50 may be actuated as movement may be prohibited (e.g., limited). As depicted in FIG. 5B, the well 10 is now in condition for production.

U.S. Pat. No. 8,347,968 B2 to Debard et al., assigned to Schlumberger Technology Corporation, issued 8 Jan. 2013 is incorporated by reference herein.

Figure 6:
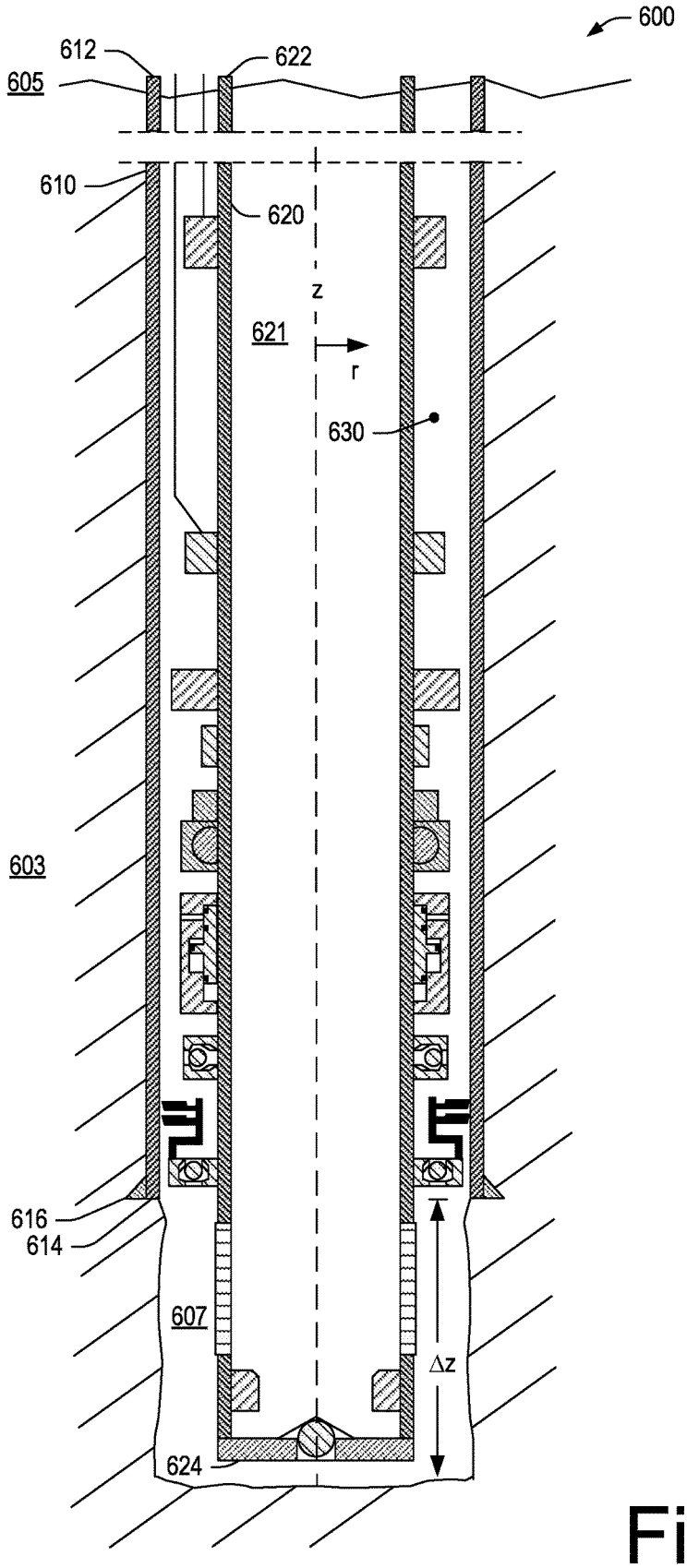
FIG. 6 illustrates an example of an assembly in an environment.

FIG. 6 shows an example of a completion assembly 600 as disposed in an environment that includes a subterranean portion 603 and a surface 605 where a casing 610 extends from a surface end 612 to a downhole end 614 where a casing shoe 616 may be located. Below the downhole end 614 of the casing 610, an open hole 607 exists as a portion of the borehole that extends to the surface 605.

In FIG. 6, a tubing 620 defines a tubing bore 621 and an annulus 630 between an outer surface of the tubing 620 and an inner surface of the casing 610. In the schematic representation of FIG. 6, the tubing 620 can be an assembly of components and referred to as a completion assembly. The tubing 620 can be defined in part by an uphole or proximal end 622 and a downhole or distal end 624. As shown in FIG. 6, a coordinate z may be utilized to define an axial location of a component, the subterranean portion 603 of the environment, fluid, etc. As shown, a coordinate r may be utilized to define a radial location of a component, the subterranean portion 603 of the environment, fluid, etc. As an example, an azimuthal coordinate Θ may be utilized to define an azimuthal location of a component, the subterranean portion 603 of the environment, fluid, etc.

Figure 7:
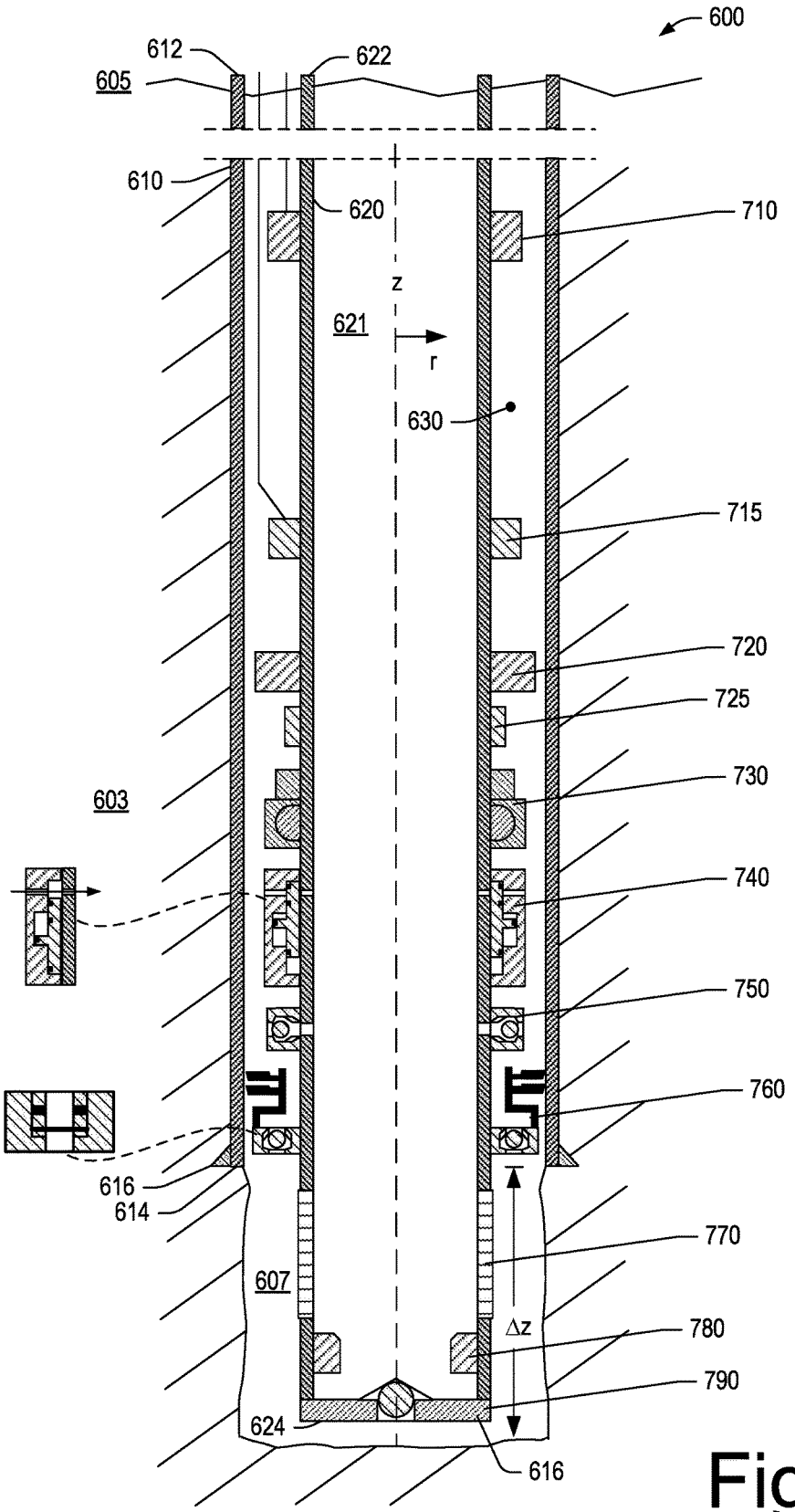
FIG. 7 illustrates an example of an assembly in an environment.

FIG. 7 shows various components of the example of FIG. 6, including a surface controlled subsurface safety valve (SCSSV) 710, a pressure and temperature gauge 715, a packer with a hydrostatically setting module (HSM) (e.g., consider the XHP packer, Schlumberger Limited, Houston, Tex.), a nipple profile 725, a formation isolation valve (FIV) 730 (e.g., that may include a rupture disc to close and a gas spring to open), a circulation valve 740 (e.g., a KICK START pressure actuatable circulation valve, Schlumberger Limited, Houston, Tex.), a flow restrictor 750 (e.g., to allow flow from the annulus 630 to the tubing bore 621 and restrict flow from the tubing bore 621 to the annulus 630), a fluid loss control device 760, a screen 770, a plug seat 780 and a washdown shoe 790.

As shown, the circulation valve 740 can include a piston that can move to open one or more flow paths that establish fluid communication between the annulus 630 and the tubing bore 621.

As shown, the fluid loss control device 760 may include one or more rupture discs, which may act as pressure actuatable valves. As shown, the fluid loss control device 760 can include a plurality of check valves that allow for flow from the open hole 607 to the annulus 630 but that restrict flow from the annulus 630 to the open hole 607 (e.g., where a rupture disc, if present, is not ruptured).

As an example, the fluid loss control device 760 may include one or more features of a completions fluid loss control system as described in U.S. Patent Application Publication No. US 2013/0180735 A1, to Patel (published 18 Jul. 2013), which is incorporated by reference herein.

Figure 8:
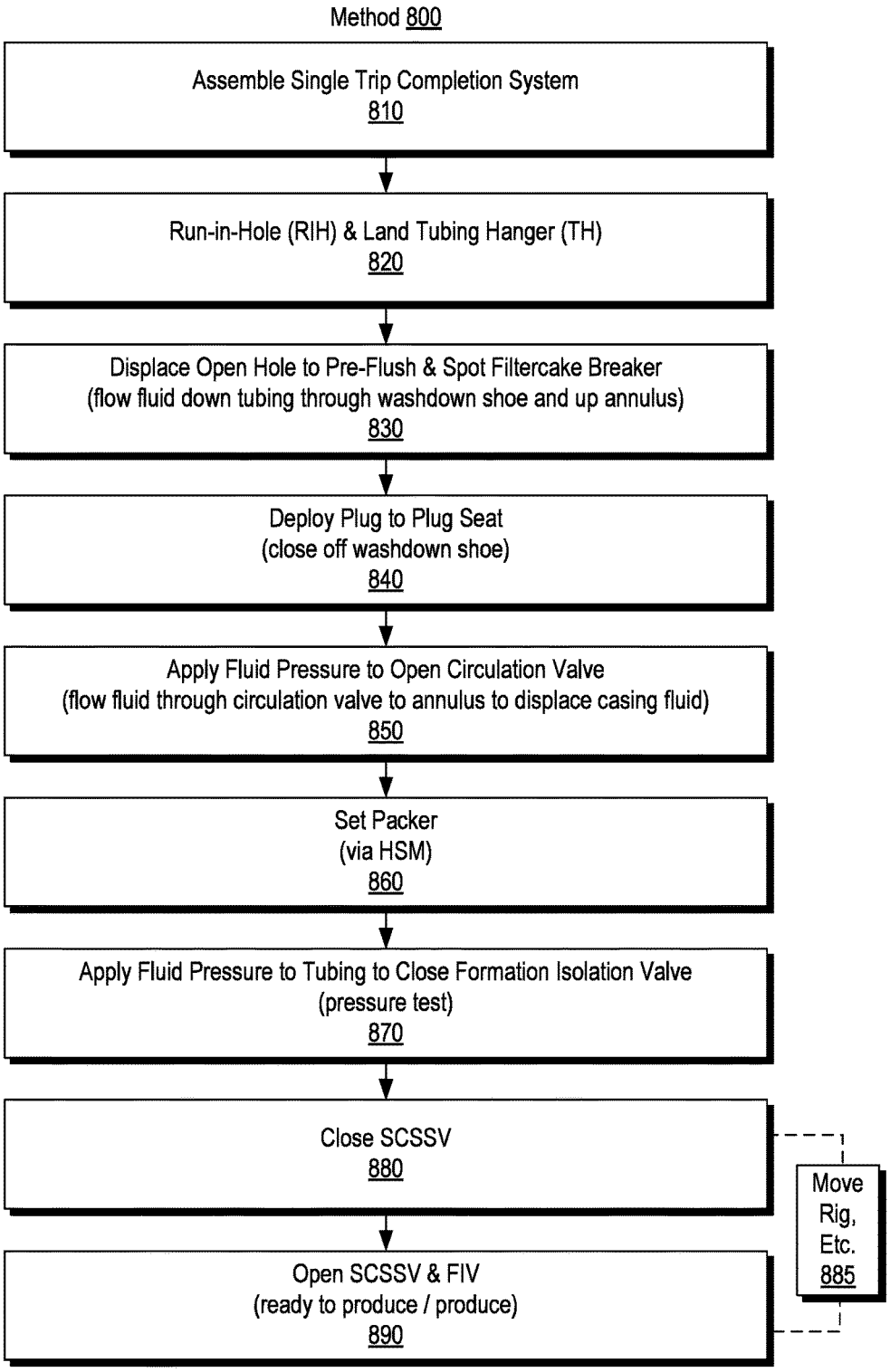
FIG. 8 illustrates an example of a method.

FIG. 8 shows an example of a method 800 that may utilize equipment as illustrated in FIGS. 6 and 7. The method 800 includes an assembly block 810 for assembling a single trip completion system (e.g., the "system"), a run-in-hole (RIH) & land tubing hanger block 820 for running the system in a cased portion of a borehole to an uncased portion of the bore hole, a displacement block 830 for displacing open hole fluid to pre-flush and spot filtercake breaker (e.g., via flowing fluid down tubing through a washdown shoe and up an annulus), a deployment block 840 for deploying a plug to a plug seat (e.g., to close off the washdown shoe), an application block 850 for applying pressure to open a circulation valve (e.g., to flow fluid through the circulation valve to an annulus to displace casing fluid with "packer" fluid), a set block 860 for setting a packer (e.g., via an HSM via application of pressure), an application block 870 for applying fluid pressure to tubing to close a formation isolation valve (FIV) (e.g., and pressure testing), a close block 880 for closing a surface controlled subsurface safety valve (SCSSV), and an open block 890 for opening the SCSSV and the FIV such that the system is ready to produce fluid (e.g., to flow fluid through one or more screens from the open hole to the tubing).

As shown in the example of FIG. 8, a move block 885 may include moving a rig to another location, etc. For example, where a tubing assembly includes two fluid flow barriers in a tubing bore, a portion of the tubing assembly can be secured as to limiting flow of fluid from a formation through the tubing bore. In such an example, the open block 890 may be performed at a desired time, upon occurrence of desired circumstances, etc.

As an example, the move block 885 may include unlatching a portion of a completion from another portion of a completion. For example, consider unlatching an upper completion from a lower completion and pulling the upper completion out of hole (POOH). In such an example, an annulus of the lower completion with respect to a formation may be sealed via a packer and a bore of the lower completion may be sealed with one or more mechanical barriers. For example, the method 800 of FIG. 8 can include establishing two mechanical barriers in a bore. Such an approach may provide for hindering of flow of fluid from a formation or to a formation via a bore of a completion and/or via an annulus formed by a completion with respect to a formation (e.g., in an open hole section). As an example, where a portion of a completion has been pulled out of hole, at a later time the completion, components thereof, or another completion may be run in hole (RIH) and operatively coupled to the sealed off portion of the completion that remains in the hole. In such an example, a portion that remains in the hole can include a polished joint or other type of joint. For example, a polished bore receptacle (PBR) can be utilized as part of a lower completion that remains in hole (e.g., after a single trip downhole) where an upper completion may optionally be unlatchable and, for example, pulled uphole. In such an example, the upper completion may include one or more seal assemblies that can form a seal with respect to a polished bore of the PBR (see, e.g., one or more of FIGS. 16 to 24).

As to the assemble block 810, it can make-up a single trip completion system (STCS), which includes, from uphole to downhole: a surface controlled subsurface safety valve (SCSSV); a pressure and/or temperature gauge (P/T); a hydrostatic setting module (HSM) for a packer; a nipple profile; a surface controlled formation isolation valve (SFIV) that includes a rupture disc to close and a nitrogen spring to open; a pressure actuated kick start circulation valve (KSCV) (e.g., as may be used in first stage fracturing); a flow restrictor that allows flow from casing to tubing but checks from tubing to casing; a fluid loss control device that allows flow from below to annulus above; a screen(s); a ball seat; and a washdown shoe.

As an example, after closing off the washdown shoe 790, a method can include opening the circulation valve 740 by applying a first pressure (e.g., 1000 psi or 69 bar, where 1 bar is equal to 100 kPa) in the tubing bore 621 tubing to rupture a rupture disc of the circulation valve 740. In such an example, fluid can flow from the tubing bore 621 to the annulus 630 in a region that is uphole the fluid loss control device 860 and downhole the packer 720. Such an approach can displace fluid in the annulus 630 (e.g., casing fluid) with fluid flows from the tubing bore 621 to the annulus 630 (e.g., packer fluid).

As an example, the first pressure can be sufficient to cause the HSM to set the packer 720. For example, the first pressure may rupture a rupture disc of the HSM associated with the packer 720 to set the packer 720. In such an example, the packer 720 may be pressure tested in one or more manners. For example, consider applying pressure via the tubing bore 621 to pressure test the packer 720 from below via tubing (e.g., to 2000 psi or 138 bar) and/or applying pressure via the annulus 630 to pressure test the packer 720 from above via annulus (e.g., to 5000 psi or 345 bar). In such examples, the test pressures may be a first test pressure and a second test pressure that are greater than the first pressure (e.g., greater than 1000 psi or 69 bar).

As an example, to close the formation isolation valve (FIV) 730, a second pressure may be applied via the tubing bore 621 (e.g., to 3000 psi or 209 bar), which may cause a rupture disc of the FIV to rupture and close the FIV 730. In such an example, as the packer 720 is set and the fluid loss control device 760 is in place, pressure can build in the tubing bore 621 to rupture such a rupture disc to close the FIV 730 (e.g., 3000 psi or 209 bar in the tubing bore 621). In a closed state, the FIV 730 can be a barrier (e.g., a flow barrier). As an example, where the SCSSV is closed, it may be a barrier (e.g., a flow barrier). In the method 800 of FIG. 8, at the close block 880, the system can include two mechanical barriers that are deployed as flow barriers.

Various options, which may be additional and/or alternative to the method 800 and/or equipment employed. As an example, an option may be a contingency option.

As an example, a screen or screens can include RESFLOW technology and/or RESCHECK technology (Schlumberger Limited, Houston, Tex.). The RESFLOW technology includes the RESFLOW CV check-valve inlet control device (ICD) as an inflow control device that helps to reduce actions such as deployment of a washpipe for well cleanup (fluid displacement) and for setting openhole hydraulically set packers. As to the RESCHECK technology, a check-valve assembly may be utilized that can include a ceramic nozzle, a ceramic or aluminum ball, and an aluminum plate. In such an example, the check-valve assembly can help to prevent fluid loss through nozzles during washdown and then can help control flow of hydrocarbons during production.

As to the application block 850, a contingency option can include deploying a degradable plug if a check valve leaks and/or mechanically opening a valve by running in hole a shifting tool on coiled tubing or a tractor. As to utilization of a degradable plug, consider the tubing 620 including a plug seat that is uphole from the screen(s) 770. Such an approach may be a contingency action where a check valve and a "plugged" washdown shoe leak.

As to the set block 860, a contingency can include increasing pressure in the tubing bore 621 (e.g., applying 2,000 psi or 138 bar in tubing), closing the FIV, utilizing a RIH shifting tool on coiled tubing (CT) or a tractor to shift a sleeve to uncover a fluid communication port (e.g., a fluid communication passage) and applying pressure (e.g., 4000 psi or 276 bar in the tubing bore 621) to hydraulically set the packer 720.

As to the application block 870, a contingency can include running a shifting tool on a coiled tubing or a tractor to close the FIV 730.

As to the open block 880, it may include opening the SCSSV 710, applying and/or bleeding off tubing pressure (e.g., pressure cycling) and opening the FIV 730. As an example, a contingency can include running a shifting tool on coiled tubing or a tractor to shift a sleeve to open a pressure equalizing port across a piston and mechanically opening the FIV 730. As another example, a mill ball may be deployed.

As an example, a workflow can include performing one or more workovers. As an example, a workover can include retrieving an upper completion where, for example, a no go plug may be deployed to seat in the nipple profile 725. As an example, a method can include performing a workover that includes running a plug in the tubing bore 621 to isolate a formation (e.g., a portion of the subterranean portion 603), cutting the tubing 620 above the packer 720 and retrieving the upper completion (e.g., the cut portion above the packer 720).

In the foregoing example workover, a method can include running the upper completion back into the hole, pressuring the tubing bore 621 and the annulus 630, setting the packer 720 hydraulically, and testing the packer 720 from below (e.g., pressure testing). In such an example, the plug seated in the nipple profile 725 may be retrieved and production commenced.

The method 800 of FIG. 8 can be implemented in a robust manner, with relatively high reliability. Such an approach can alleviate leak path(s) (e.g., no seals) above the production packer 720. Such an approach may utilize two control lines, for example, a hydraulic control line for the SCSSV 710 and an electric line for the pressure and temperature gauge 715.

The method 800 may be implemented in a manner that can implement mechanical fluid loss control during RIH. The method 800 can create two mechanical tubing barriers (e.g., mechanical flow barriers as to flow in the tubing bore 621). The approach of FIG. 8 as utilizing equipment of FIG. 7 can include washdown capability. As an example, a method can include displacing annulus fluid with packer fluid after landing a hanger.

As an example, a tubing assembly can include a FIV that may include a rupture disc. For example, consider replacing a "close" hydraulic control line with a rupture disc and/or replacing an "open" hydraulic control line with a gas spring unit (e.g., a nitrogen spring unit of the FIV II N2 TRIP SAVER formation isolation valve, Schlumberger Limited, Houston, Tex.). As an example, a surface controlled bi-directional isolation valve (e.g., SFIV-II, Schlumberger Limited, Houston, Tex.) may be utilized, optionally in a modified condition. As an example, a valve may include one or more features of the SFIV-II or another commercially available valve (e.g., FIV II N2 TRIP SAVER FIV, etc.).

As an example, a tubing assembly can include a fluid loss control device, which may be a modified packer. For example, consider modification of the MZ packer (Schlumberger Limited, Houston, Tex.) by replacing shunt tubes with MCCV flow restrictors (see, e.g., FIG. 9).

As an example, a FIV may be a surface controlled FIV (e.g., an SFIV) or may be an intervention-based FIV. For example, an intervention-based FIV may include intervention to close and another mechanism to open (e.g., gas spring). As an example, an intervention-based FIV may be utilized as a contingency where a completion is not able to get to bottom (e.g., due to tight spots). As an example, a method can include running a sacrificial drill below a screen or screens.

As an example, a SFIV can be of a type that is operable by applying pressure from surface in hydraulic control line(s). For example, consider either two lines (e.g., one to open chamber and one to close chamber) or a single control line from surface with an indexer and/or a hydraulic switch for actuating the valve when one penetration is available in a tubing hanger. In either case the actuation pressure can be applied from surface in a hydraulic control line to open and close the valve.

As an example, a tubing assembly can be without a hydraulic switch control line. As an example, in a deep well the control line fluid hydrostatic pressure can be less than at least by 1,000 psi (e.g., 69 bar) the tubing pressure at a valve depth (e.g., a valve controllable by the control line). In such circumstances, rather than including a hydraulic control line connected to hydraulic chamber to close the valve, a hydraulic chamber can be ported to tubing pressure (e.g., in pressure communication with a tubing bore pressure).

As an example, a valve operator (e.g., a piston mechanism, etc.) can be cycled by applying pressure in a hydraulic control line greater than the tubing pressure and bleeding off applied pressure in control line. In such an example, the differential pressure from tubing to hydraulic control line pressure moves the valve operator in one direction (e.g., axially) and the differential pressure from control line to tubing pressure moves the valve operator in opposite direction (e.g., axially). Such an opposing motion approach of the valve operator can be used to open and close a valve, for example, either with a single motion or with multiple cycles as desired for more than one up and down cycle (e.g., which may help to prevent the valve from unintended operation).

As an example, a valve can be a ball valve. Such a ball valve can be run deep in a well to provide a barrier to formation fluid. In such an example, the valve can be closed remotely (e.g., interventionless) by applying pressure in the tubing bore that is higher than the pressure in hydraulic control line at the valve depth. As an example, in a well where pressure cannot be applied in a tubing bore because of open perforation or open hole, a ball seat may be run below the valve and a degradable ball dropped or pumped down to the ball seat such that pressure can be applied in the tubing bore against the degradable ball (e.g., or other shaped degradable plug) to close the valve. As an example, a lighter non-degradable ball may be used instead of degradable ball in some cases where such a lighter ball (e.g. plug) may be flowed back to surface.

The approach of an interventionless mechanism for valve operation (e.g., for transition from a closed state to an open state or from an open state to a closed state) can be used for actuating one or more types of valves (e.g., sliding sleeve valve, disc valve, flapper valve, etc.). As an example, one or more types of mechanisms may be utilized for remote closing of a valve. For example, consider one or more of the EFIRE head technology (Schlumberger Limited, Houston, Tex.), a rupture disc, an RFID tag or tags, an electro hydraulic valve operator and opening with hydraulic control line.

As an example, a tubing assembly may include a dual valve subassembly or tool. For example, consider the INTELLIGENT REMOTE DUAL VALVE (IRDV) subassembly or tool (Schlumberger Limited, Houston, Tex.).

The IRDV subassembly is a multicycle, independent dual valve tool command and control technology. The IRDV tool allows independent command of two valves in a tool string:

a testing valve and a circulating valve. The IRDV tool may be operated via the IRIS intelligent remote implementation system (Schlumberger Limited, Houston, Tex.), the IRDV tool can operate both valves in multiple conditions and can be immune to downhole pressure and temperature changes.

The IRDV tool features a nitrogen-free, hydrostatically powered testing and circulating valves in one tool. Low-pressure pulses in an annulus can enable independent multicycle operation of both valves without interfering with operation of other tools. The IRDV tool, as part of the QUARTET downhole reservoir testing system (Schlumberger Limited, Houston, Tex.) with by MUZIC wireless telemetry technology (Schlumberger Limited, Houston, Tex.), can be controlled using wireless commands or low-pressure pulses, can provide real-time tool feedback, and/or can allow bidirectional communication for tool command and verification.

The IRDV tool offers a variety of command options to provide flexibility and diversity to operate for specific applications in which low-pressure pulses, system-activation compatibility, or sequential and automatic valve operation is desired.

As an example, a tubing assembly can include an IRDV with a circulation valve and test valve that can be open while running in hole to land a tubing hanger.

As an example, a method can include running in hole a tubing assembly with an IRVD tool (e.g., as a replacement for a FIV and a CV), washing down (e.g., pump fluid in a tubing bore) while sending a wireless command to close the circulation valve of the IRVD tool. Such a method can include continuing to RIH while sending a wireless command to open the circulation valve of the IRVD tool. As an example, a method can include opening the circulation valve and test valve of the IRDV tool together with landing a tubing hanger. In such a method, production may commence.

As an example, a method can include displacing open hole to pre-flush and spot filtercake breaker. Such a method can include sending a wireless command to close a circulation valve of an IRDV tool. Such a method can include sending a wireless command to close a test valve of the IRDV tool and to open the circulation valve of the IRDV tool, followed by circulating an annulus with packer fluid (e.g., to displace annulus fluid with packer fluid). Such a method can include sending a wireless command to close both valves of the IRDV tool and applying fluid pressure to a tubing to transmit such pressure to set a packer. In such an example, two mechanical barriers may be implemented, for example, by closing an SCSSV and having the two valves of the IRDV tool closed.

As an example, where two mechanical fluid barriers have been established in a completion (e.g., a tubing assembly), a rig that has been utilized to locate the completion in a borehole may be moved to another location. For example, the completion process may be established such that production can commence at a desired time via opening of the barriers. In the foregoing SCSSV and IRDV tool example, three valves can be opened to open the barriers to commence production.

As an example, a workflow can include running in hole a completion assembly with a disconnect between an upper completion (e.g., upper section) and a lower completion (e.g., lower section). Such a workflow can include pulling a plug out of hole and producing. In such a workflow, the completion assembly can include a PBR and seal assembly shear pinned RIH subassembly that is positioned above a packer.

As an example, a method can include running in hole a tubing assembly and landing a tubing hanger. In such an example, the tubing assembly can include a direct (e.g., on/off) hydraulic formation control valve, a packer with HSM, and the IRDV tool, as well as, for example, the fluid loss control device.

As an example, as to a contingency where a screen(s) of a tubing assembly is not able to reach total depth (TD), a method can include displacing open hole to pre-flush and spot filtercake breaker, opening a circulation valve (e.g., applying pressure to a tubing bore to open the circulation valve), and displacing annulus fluid with packer fluid to above a packer. In such an example, the circulation valve may be opened via a rupture disc with a burst pressure that is approximately equal to the hydraulic pressure at a design TD minus the hydraulic pressure at the design TD minus the hydraulic pressure at depth plus another pressure (e.g., 1000 psi (e.g., 69 bar), etc.). In such an example, the tubing assembly can include the FIV 730 and the circulation valve 740 of FIG. 7. Such a method can include rupturing a rupture disc with a burst pressure of the hydraulic pressure at design TD minus the hydraulic pressure at depth plus a pressure (e.g., 1000 psi (e.g., 69 bar), etc.) to set a packer. Following setting of the packer, the method can include closing the FIV and then running a plug in a tubing bore to a nipple profile to establish a second mechanical barrier in the tubing bore.

Where two mechanical barriers to flow in a tubing bore have been established in a portion of a completion system, a method may include cutting or otherwise detaching a portion of the completion system at a location above a packer (e.g., an annulus barrier) and above both mechanical barriers. Where a portion is cut or otherwise detached, that portion may be pulled out of the hole (POOH).

Where a portion of a completion system is disposed in a lower portion of a borehole (e.g., a well) where mechanical barriers are established in a tubing bore of the portion, such a portion may be a lower completion (e.g., lower section) and, for example, another portion may be run in hole (e.g., an upper completion or upper section) that can be operatively coupled to the lower completion.

As an example, a method can include RIH an upper completion, displacing annulus fluid with packer fluid, pressuring up a tubing bore and an annulus, hydrostatically setting a packer, and pressure testing the packer from below.

As an example, the aforementioned method can include pulling out of hole (POOH) a plug (e.g., an uppermost mechanical barrier) and opening a FIV (e.g., a lowermost mechanical barrier).

Figure 9:
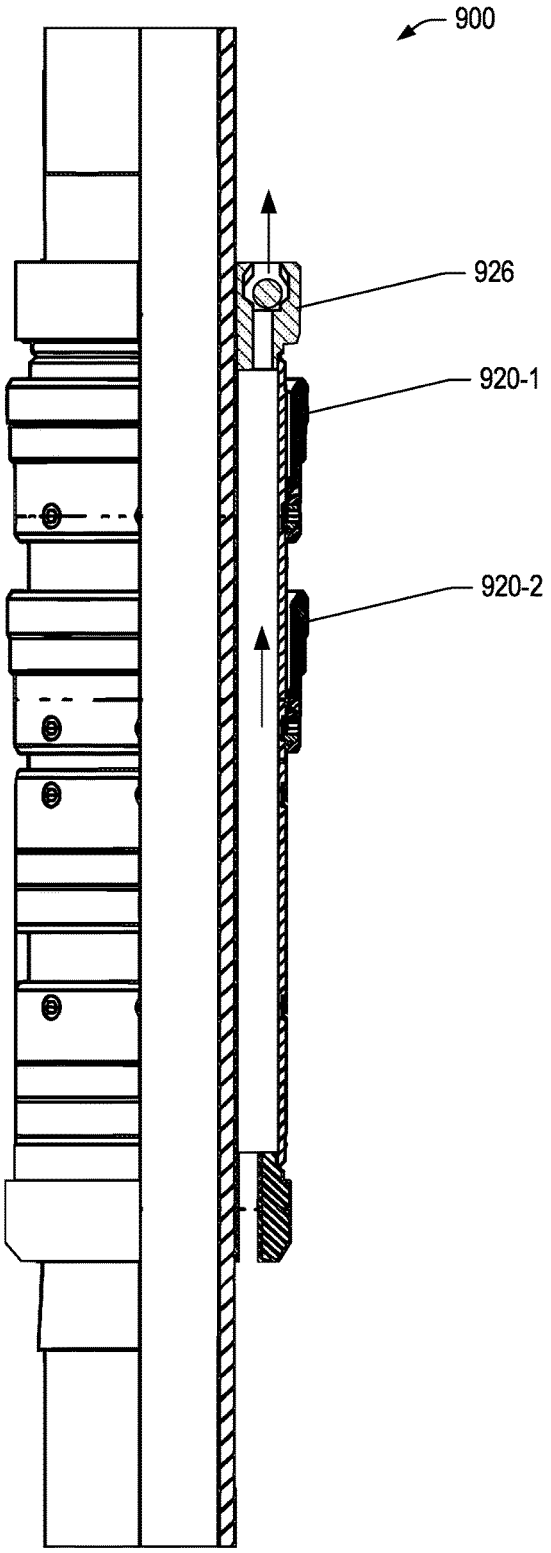
FIG. 9 illustrates an example of a subassembly.

FIG. 9 shows an example of a subassembly 900 that includes at least one packer 920-1 and 920-2 and at least one fluid flow restrictor 926. As shown, the one or more packers 920-1 and 920-2 can include rubber cups and the at least one fluid flow restrictor can include one or more check valves that include, for example, a moving ball that moves to allow flow in a one direction and to hinder flow in an opposing direction. As an example, a flow restrictor may be of a diameter of approximately 1 cm (e.g., approximately 0.5 inch inner diameter). As an example, the subassembly 900 can include various features of the aforementioned MZ packer.

Figure 10:
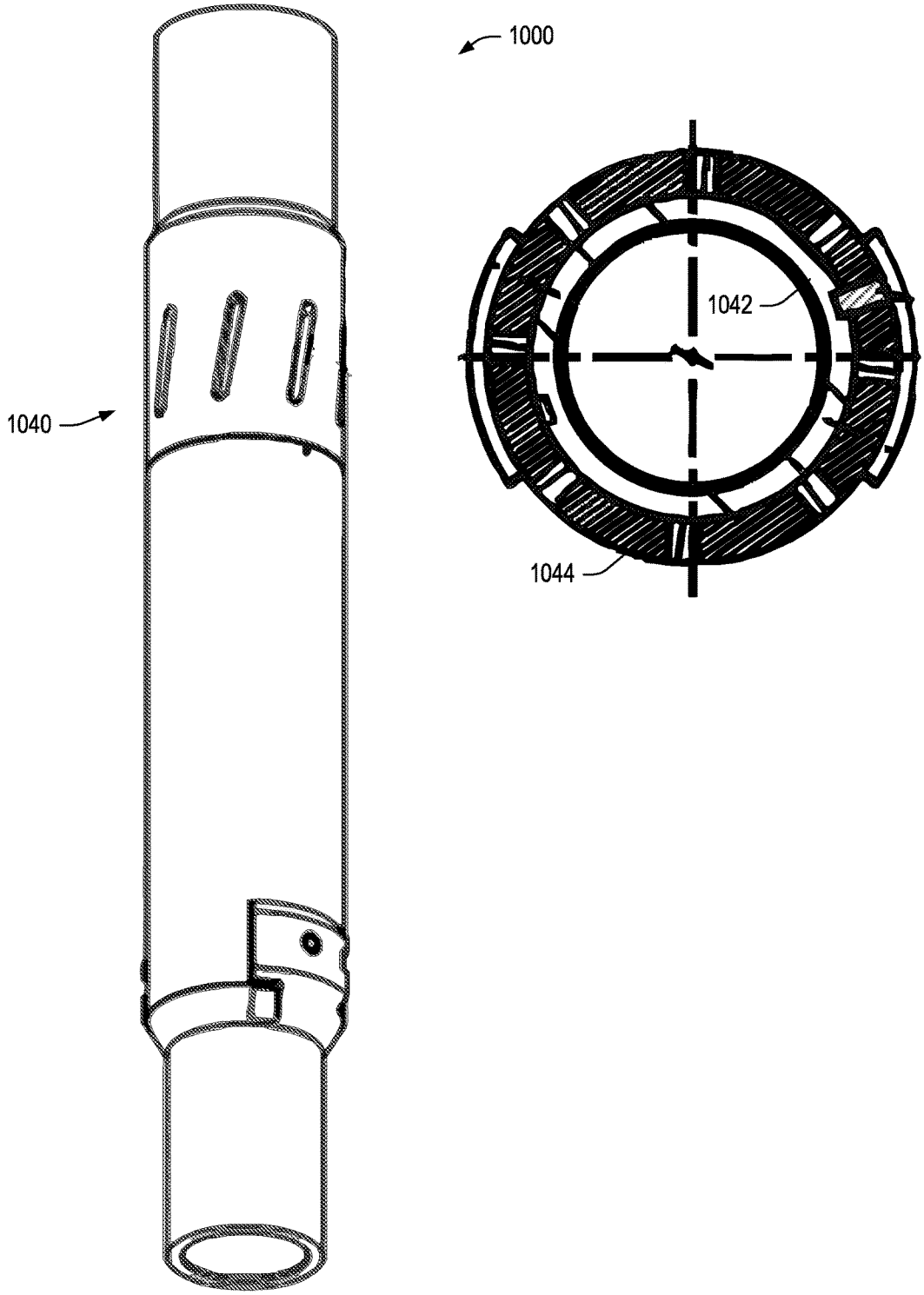
FIG. 10 illustrates an example of a subassembly.

FIG. 10 shows an example of a subassembly 1000 that includes a circulation valve portion 1040, which may include features of the KICK START circulation valve. As shown, the circulation valve portion 1040 includes an inner portion 1042 and an outer portion 1044 that can be aligned in a manner to provide for fluid communication between an interior space and an exterior space. Such portions 1042 and 1044 may be aligned, for example, as one portion moves with respect to the other portion.

As an example, a tubing assembly can include a specialized formation isolation valve. For example, consider a specialized version of the FIV II (Schlumberger Limited, Houston, Tex.). As an example, a FIV can be configured to include a single ball safety valve (SBSV) and a rupture disc (e.g., for ball valve operation).

Figure 11:
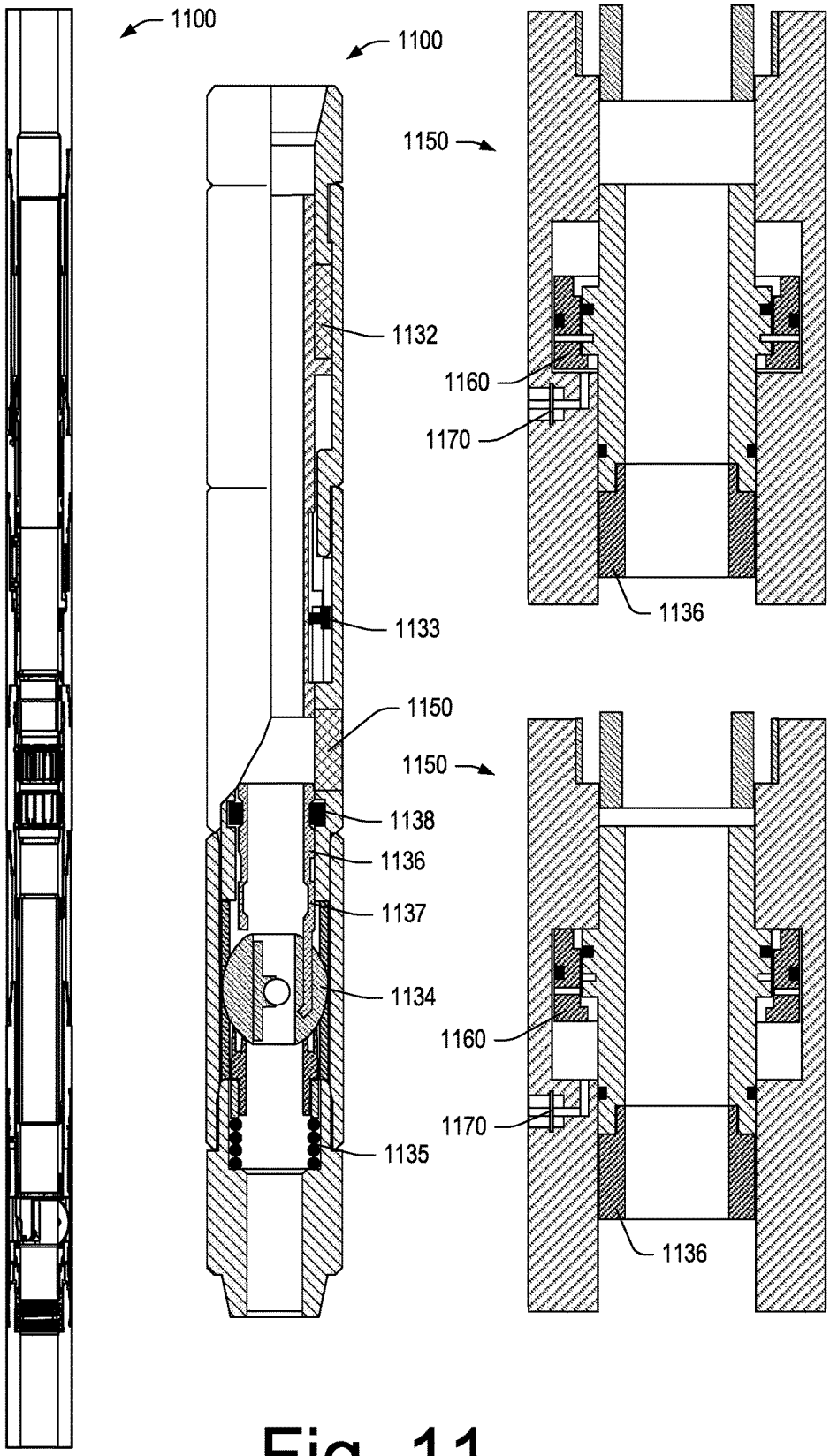
FIG. 11 illustrates examples of equipment.

FIG. 11 shows an example of a subassembly 1100 in a cross-sectional view and in an approximate cutaway view, which illustrates various features, including a nitrogen spring 1132, a counter 1133, a ball valve 1134, a spring 1135, a latch 1136 (e.g., a ball valve operator) that includes a latch profile 1137 and a detent 1138. In the example of FIG. 11, the ball valve 1134 is in an open state. In the example of FIG. 11, the latch 1136 is movable to be operatively coupled to the ball valve 1134 for transitioning the ball valve 1134 from one state to another state.

FIG. 11 also shows an assembly 1150 that can be included for one time remote closing of the ball valve 1134. In such an example, the assembly 1150 can include a split piston 116 and a rupture disc 1170 that ruptures at a given pressure. In the example of FIG. 11, the upper illustration shows the assembly 1150 configured to correspond to an open state of the ball valve 1134, which may be a RIH state of the subassembly 1100 while the lower illustrations shows the assembly 1150 configured to correspond to a closed state of the ball valve 1134, where the rupture disc 1170 has been ruptured and the split piston 1160 translated axially upwardly. Where the rupture disc 1170 has ruptured, pressure may equalize in chambers associated with the split piston 1160. As shown, upward translation of the split piston 1160 allows the latch 1136 to translate axially upwardly to rotate the ball 1134 to a closed position, which acts as a barrier to fluid flow in the subassembly 1100 (e.g., in a bore of the subassembly 1100).

Figure 12A:
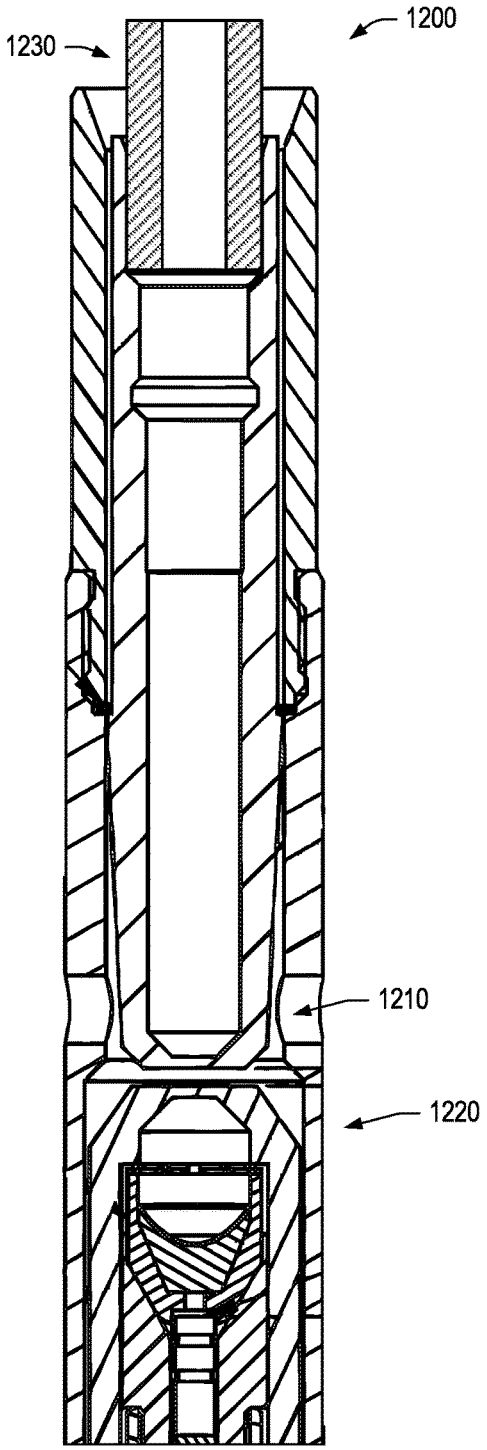
FIGS. 12A and 12B illustrate examples of an actuatable valve in two states.
Figure 12B:
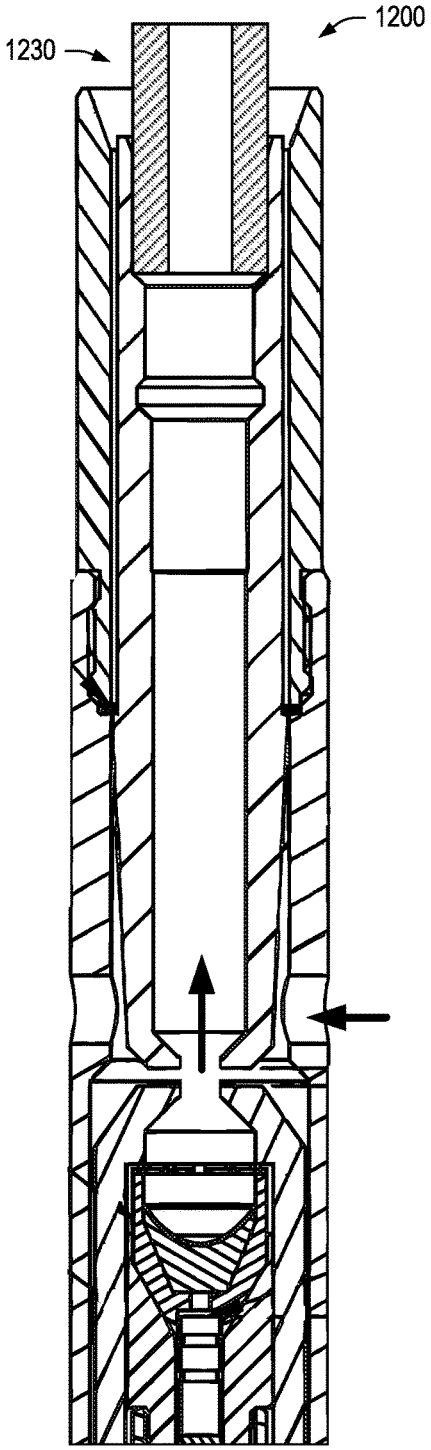

FIGS. 12A and 12B show an example of an actuatable valve 1200 that includes a sealed valve portion 1210 and an explosive charger portion 1220. Such a valve can include features of the EFIRE head. Such a valve can be a kick start valve. The actuatable valve 1200 can include a pressure barrier that is broken upon discharge of a charge. As shown, a flow port or flow ports can be in fluid communication with a bore of the actuatable valve 1200 after the pressure barrier is broken. As shown in FIGS. 12A and 12B, the actuatable valve 1200 can include an adapter 1230, which may allow operative coupling to a circulation valve (e.g., the KICK START circulation valve).

The actuatable valve 1200 can be utilized for one or more of packer setting, pressure testing, valve activation, circulation, prior to firing, etc. Such a valve may be programmable for low pressure initiation. Such a valve may allow for an ability to cease one or more operations.

As an example, the actuatable valve 1200 may be utilized with the KICK START circulation valve. As an example, the actuatable valve 1200 may be actuatable via one or more mechanisms (e.g., pressure, a control line, electronics, sensor(s), etc.). As an example, a rupture disc in the KICK START circulation valve may be replaced and/or supplemented with the actuatable valve 1200. As an example, a low pressure pulse may be utilized to close a circulation valve via the actuatable valve 1200 and, for example, a timer may optionally be included to issue a command to close the circulation valve.

Figure 13A:
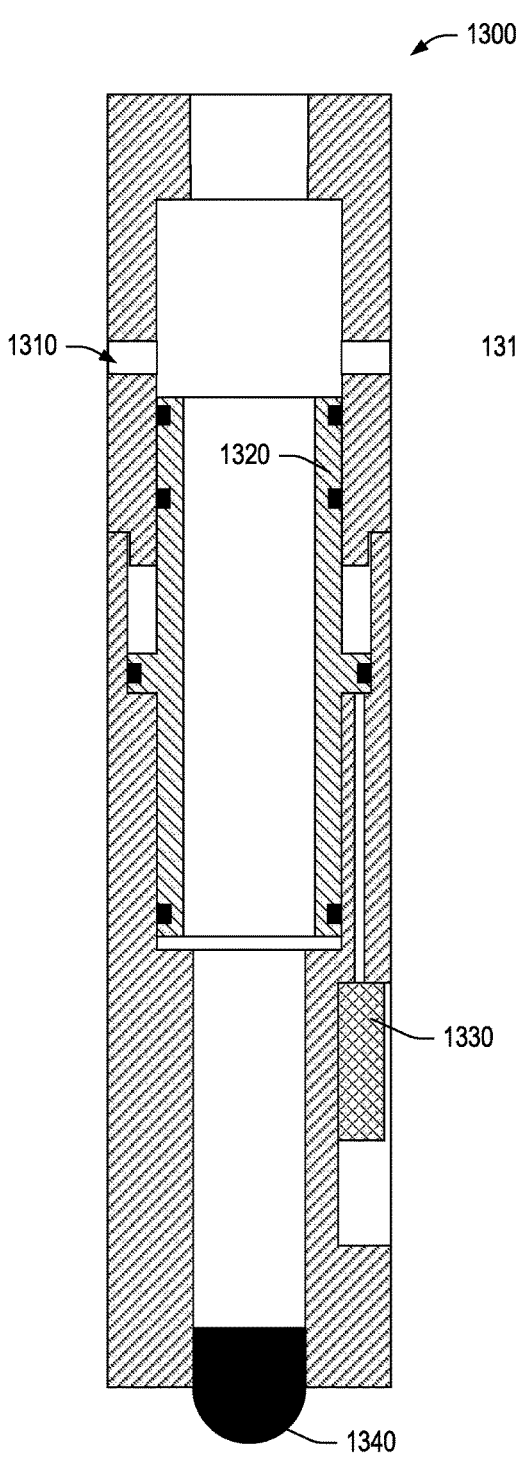
FIGS. 13A and 13B illustrate examples of equipment as including an actuatable valve in two states.
Figure 13B:
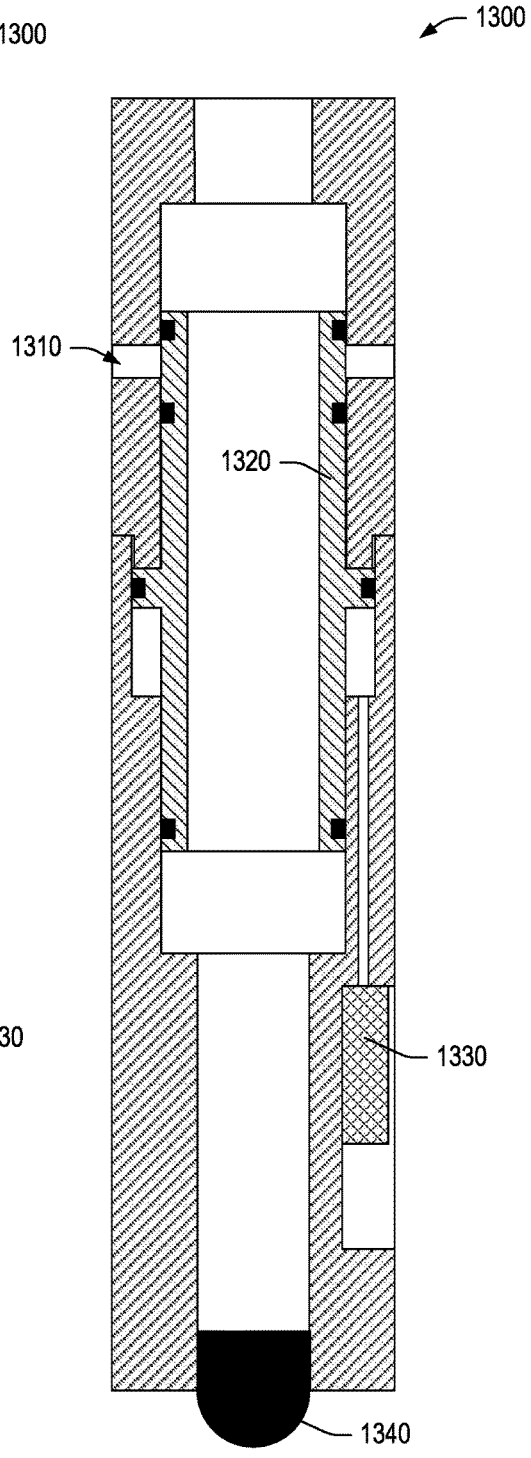

FIGS. 13A and 13B shows an example of a circulation valve 1300 that includes an actuatable valve such as the actuatable valve 1200 of FIGS. 12A and 12B, which may be, for example, electronically actuatable and/or otherwise actuatable.

In the example of FIG. 13A, the circulation valve 1300 is in an open state, which may be suitable for running in hole. The circulation valve 1300 includes flow ports 1310, a mandrel 1320 (e.g., translatable axially), the actuatable valve 1200 and a bull nose 1340. In the example of FIG. 13B, the circulation valve 1300 is in a closed state, where the mandrel 1320 has been translated axially to close the flow ports 1310. In the example of FIG. 13B, well fluid may enter the actuatable valve 1200 such that it applies fluid pressure to the mandrel 1320 (e.g., in an annular chamber) to drive the mandrel 1320 axially to cover the flow ports 1310.

As an example, an assembly may be part of a completion where the assembly may be or include a circulation valve that is actuatable via firing of a shaped charge. In such an example, the shaped charge may be actuated by one or more mechanisms (e.g., a low pressure pulse command, a timer, an electronic signal from surface, etc.). As an example, the EFIRE head may be integrated into a circulation valve such as the KICK START circulation valve, where the EFIRE head performs a function that may be performed via a rupture disc, optionally via one or more actuating mechanisms.

The EFIRE head is an electronic firing head suitable for use with tubing conveyed perforating (TCP), coiled tubing (CT), slickline, and wireline tools. Operation of the EFIRE head may be controlled from surface, optionally without prerecorded downhole parameters. As such, operations may be armed, fired, or aborted. In some embodiments, the EFIRE head or other suitable shaped charge maybe controlled using wireless telemetry such as the MUZIC wireless telemetry. In some embodiments, the EFIRE head maybe operated with pressure pulse commands. In some embodiments, a particular predetermined coded sequence of pressure pulses may be used to control the operation of the firing head.

As to a rupture disc, as part of a circulation valve, it may be actuated without intervention via coiled tubing- or tubing-conveyed perforating, for example, in a first stage of a multistage stimulation operation (e.g., a first stage of hydraulic fracturing). Such an approach may offer a faster and more cost-effective method of starting a fracturing process (e.g., particularly in horizontal and highly deviated wells).

As an example, a circulation valve such as the KICK START circulation valve can be run to the toe of a well as part of a casing string. After the casing has been cemented and tested, pressure may be increased to burst a rupture disc of the circulation valve, which can trigger shifting of a sliding sleeve of the circulation valve and opening the circulation valve, thereby exposing the formation to fracturing fluid (e.g., fracturing fluid flowing from a bore of the circulation valve to an annular space to commence fracturing). A circulation valve may include helical exit ports that are designed to reduce fracture initiation pressure and to provide substantially 360 degrees of coverage so that fractures are initiated in a desired plane. As an example, a method can include running a circulation valve in hole with the valve in an open state and subsequently transitioning the circulation valve to a closed state.

Figure 14A:
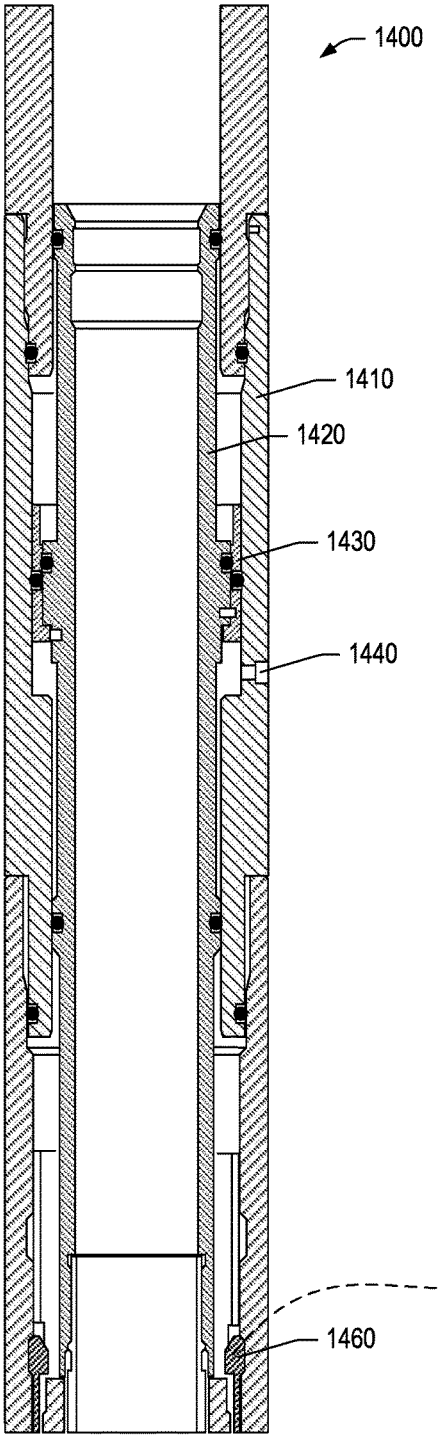
FIGS. 14A and 14B illustrate examples of equipment in two states.
Figure 14B:
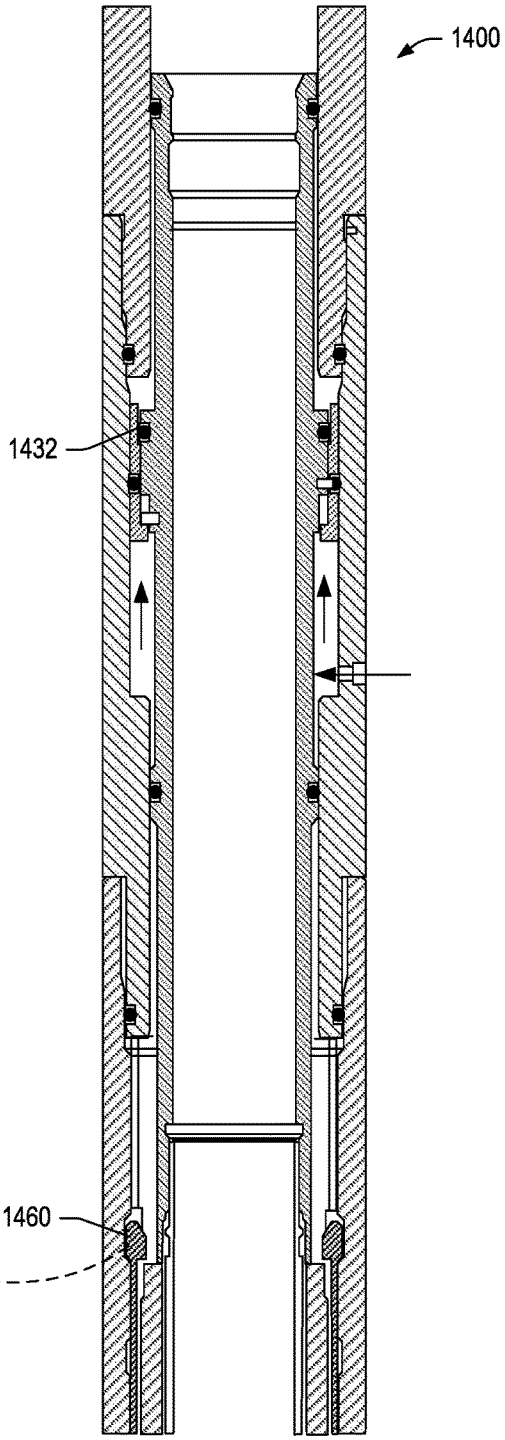

FIGS. 14A and 14B show an example of a hydraulic FIV 1400 that includes a hydraulic subassembly 1410, a piston mandrel 1420, a split piston 1430 and a rupture disc 1440. The hydraulic FIV 1400 can be associated with a ball valve as shown via the latch 1460 where, in FIG. 14A, the ball valve is in an open position (e.g., the rupture disc 1440 is intact); whereas, in FIG. 14B, the ball valve is in a closed position (e.g., the rupture disc 1440 is ruptured and the latch 1460 is translated axially). As shown in FIG. 14B, a piston ring 1432 of the piston mandrel 1420 is positioned axially such that a clearance exists that allow for an upper chamber and a lower chamber to axially ends of the split piston 1430 to be in fluid communication.

Figure 15A:
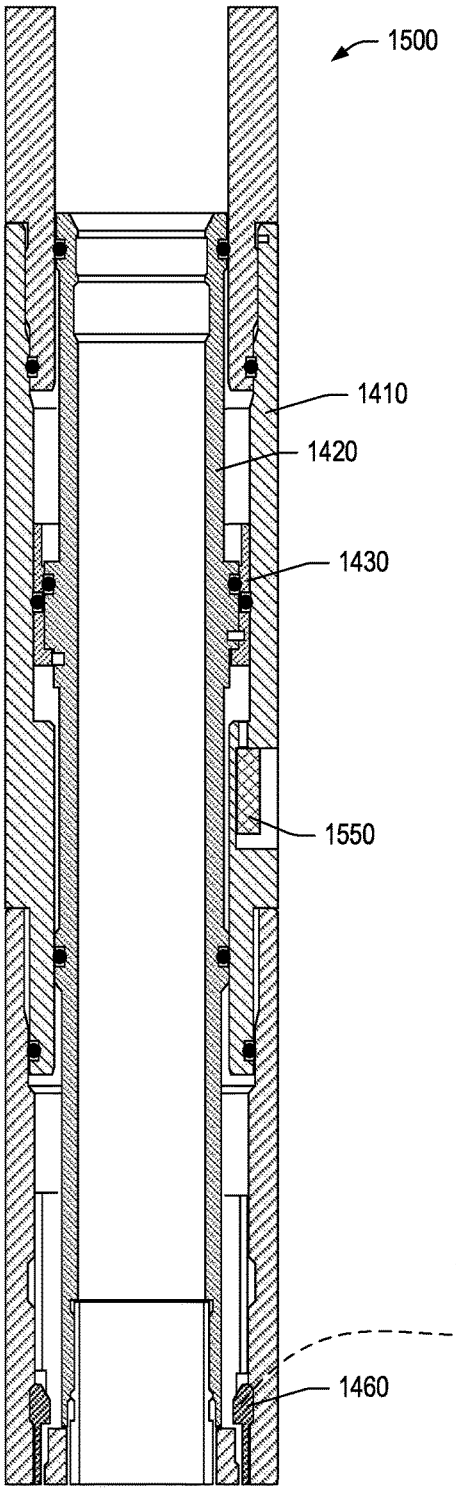
FIGS. 15A and 15B illustrate examples of equipment that include an actuatable valve.
Figure 15B:
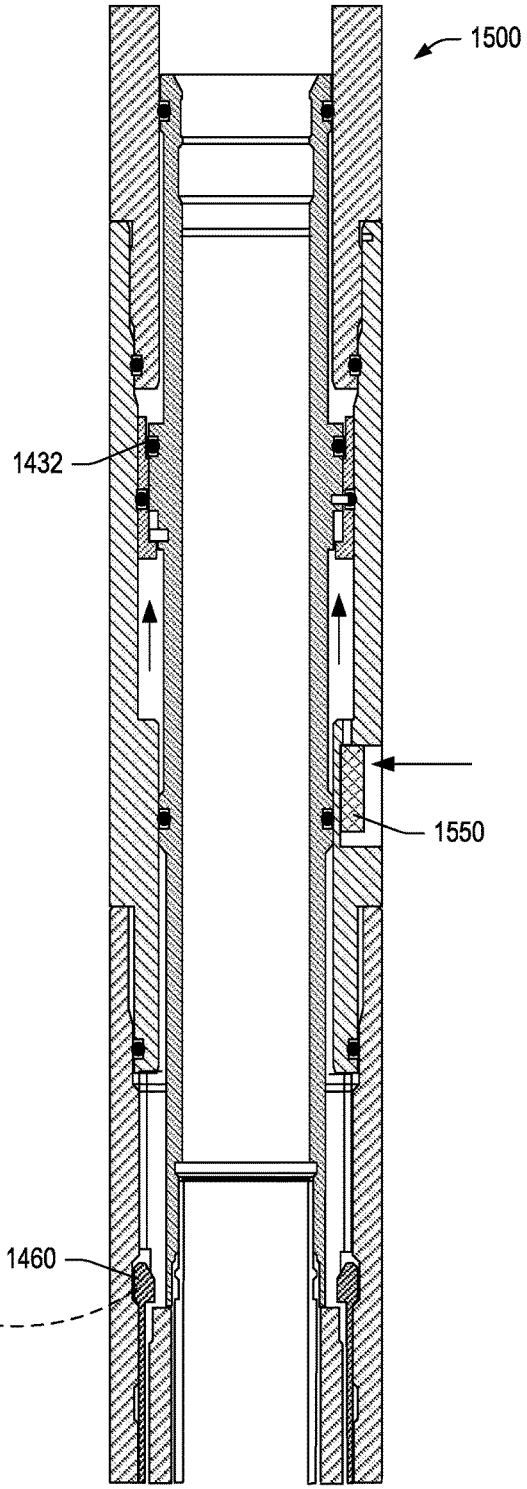

FIG. 15A and FIG. 15B show equipment as in FIG. 14A and FIG. 14B where an actuatable valve 1550 can be included and utilized to function as the rupture disc 1440 of the hydraulic FIV 1400. As an example, the actuatable valve 1550 can include one or more of the features of the actuatable valve 1200 of FIGS. 12A and 12B.

As an example, an FIV can include a rupture disc, a fireable unit, or a rupture disc and a fireable unit (e.g., an actuatable valve that includes an explosive charger).

As an example, an FIV can include features that allow for low pressure pulse command to close the FIV and, for example, a nitrogen spring to open the FIV.

As an example, wireless telemetry may be utilized, which may be acoustic telemetry. As an example, the MUZIC telemetry may be implemented. As an example, one or more of an absolute pressure, a timer, a differential pressure, an RFID, and a specialized pressure signature may be utilized to transition a state of a valve.

As an example, a control mechanism may include features that respond to applying pressure in hydraulic control line. As an example, a control mechanism may include features that respond to pressure generated by flowing fluid through a choke.

As an example, a pressure barrier may be breached (e.g., broken) via one or more of pressure, explosive charge, pressure generation by slow burning charge, etc. As an example, a barrier may be metal, a rupture disc, a piston, etc.

As mentioned, a method can include disconnecting a portion of a completion from another portion of a completion. For example, an upper completion may be disconnected from a lower completion. In such an example, the lower completion may include one or more fluid flow barriers. For example, consider a lower completion that includes two mechanical barriers to flow of fluid in a tubing bore (e.g., from a formation, via a screen(s) to a tubing bore and uphole in a tubing bore).

As an example, a tubing assembly may provide for disconnecting upper and lower completions followed by movement in one or two directions. As an example, an upper completion and lower completion can include a locking mechanism where the locking mechanism may be engaged to secure the upper completion to the lower completion, for example, during running in hole in a mid-stroke position. In such an example, one or more reliable seals may be established between an annulus space and a tubing space (e.g., a tubing bore space). As an example, such an assembly can include features that provide for unlatching (e.g., disconnecting) the upper completion from the lower completion, for example, after landing a tubing hanger (TH) and setting a packer (e.g., between an outer tubing surface and an inner surface of a casing). In such an example, tubing movement may be permissible in opposing directions. As an example, a method can include pulling out of hole (POOH) an upper completion, which may be part of a work over.

As an example, a method can include calculating a load associated with one or more portions of a completion. For example, consider a calculation based at least in part on the following values:

- 5½ inch (e.g., 14 cm) 20 lb (e.g., 9 kg) Direct Wrap Screen weight ~26 lb/ft (e.g., 12 kg/ft or 36 kg/m);
- Screen length ~4,000 ft (e.g., 1220 m);
- Hanging weight ~26 lb/ft×4,000 ft~104,000 lb (e.g., 47,000 kg);
- Packer Bull plugged ID area ~17.72 $in^2$ (e.g., 114 $cm^2$);
- Pressure to start packer slip setting ~1,500 psi (e.g., 103 bar);
- Hydraulic load=17.72 int×1,500 psi~26,580 lb (e.g., 12,000 kg);
- Total force: RIH in vertical section ~104,000 lb+10,000 lb tools ~114,000 lb (e.g., 51,700 kg);
- Total force: vertical well=104,000 lb+26,580 lb~130,580 lb (e.g., 59,000 kg); and
- Total force: deviated well=<vertical well, depends on deviation.

The aforementioned example lengths, areas and weights may be for a particular system, assembly, completion, etc. As may be appreciated, various drawings are approximate as lengths of particular sections, components, etc. may be of aspect ratios that correspond to long lengths with respect to diameters or radii. For example, consider the screen as being a 5.5 inch (e.g., 14 cm) in diameter screen with a length of approximately 4,000 ft (e.g., approximately 1220 m).

As to unlocking (e.g., disconnection options), consider utilization of one or more shear pins. Such an approach may be applied where a relatively high shear pin shear load can be applied (e.g., a substantial hanging local and hydraulic load from setting a packer). In such an example, one or more features may help to reduce risk of undesirable unlatching while running in hole.

As to unlocking (e.g., disconnection options), consider utilization of a shift to unlock mechanism, which may be implemented via intervention (e.g., moving one component with respect to another, optionally utilizing one or more tools).

As to unlocking (e.g., disconnection options), consider utilization of applying an absolute tubing pressure to actuate unlocking. In such an example, one or more features may be configured to establish a desired absolute tubing pressure where such a pressure can be applied to unlock a portion of a completion from another portion of a completion.

As to unlocking (e.g., disconnection options), consider utilizing of applying a tubing to annulus pressure differential to actuate unlocking. In such an example, one or more features may be configured to establish a desired tubing to annulus pressure differential where such a pressure differential can be achieved via application of annulus pressure and/or tubing pressure to unlock a portion of a completion from another portion of a completion. In such an example, a seal may be a configurable feature that may optionally be a non-metallic seal that is between tubing and casing.

As to unlocking (e.g., disconnection options), consider utilizing of a control line or control lines, for example, from a surface to a downhole location for purposes of actuating unlocking one portion of a completion from another portion of a completion.

As to unlocking (e.g., disconnection options), consider utilizing of absolute annulus pressure to actuate unlocking. In such an example, one or more features may be configured to establish a desired absolute annulus pressure where such a pressure differential can be achieved via application of annulus pressure to unlock a portion of a completion from another portion of a completion.

Figure 16:
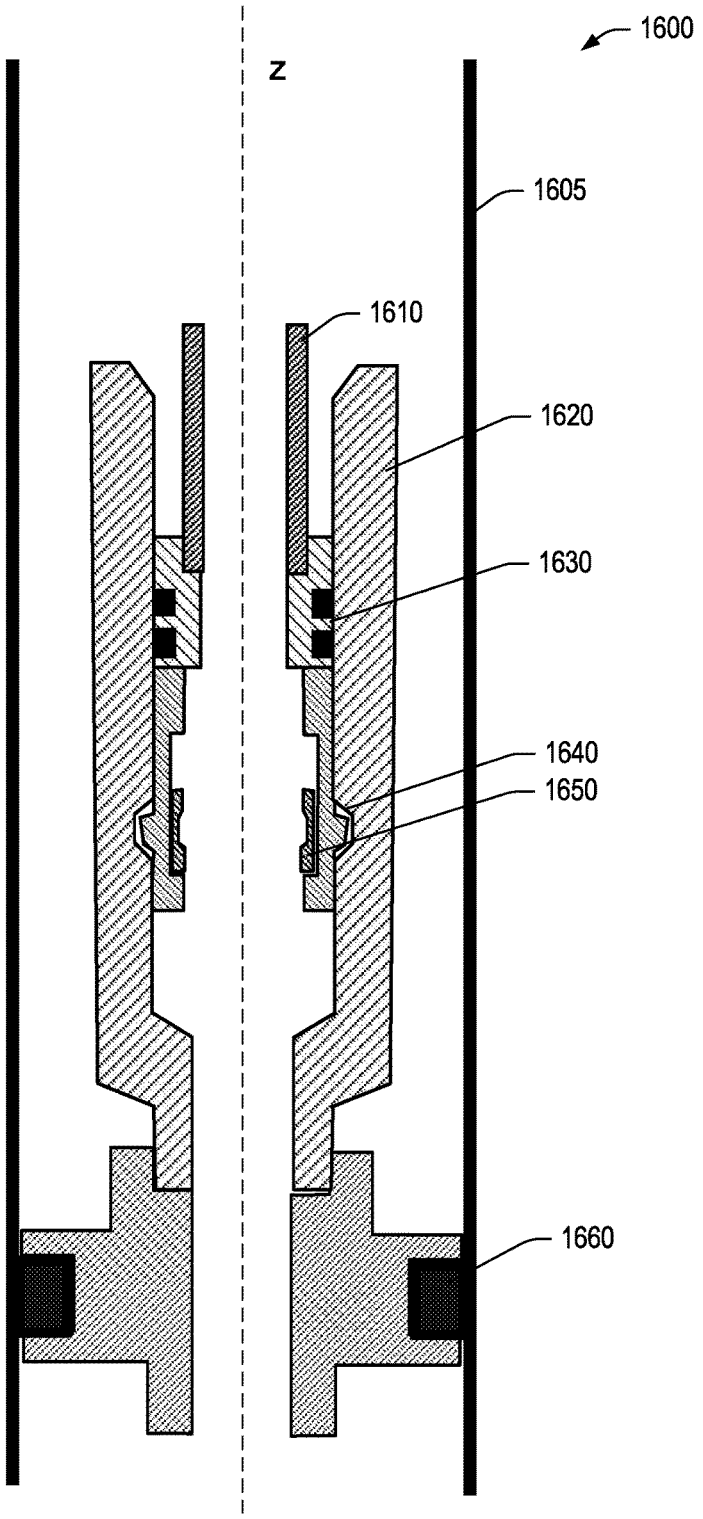
FIG. 16 shows an example of a system that includes an upper completion and a lower completion in a first state.

FIG. 16 shows an example of a system 1600 that can be run in hole (RIH) as an upper completion and a lower completion in a single trip. The system 1600 may be a subassembly or subassemblies that include cooperating features that allow for latching and/or unlatching.

As shown, the system 1600, a wellbore can be defined at least in part by a casing 1605 where an upper completion of the system 1600 includes production tubing 1610, a seal assembly 1630, a collet latch 1640 and a collet support sleeve 1650 and where a lower completion of the system 1600 includes a polished bore receptacle (PBR) 1620 and a packer 1660 (e.g., an XHP packer, etc.). As shown, the packer 1660 can be deployed to establish a seal in an annulus (e.g., from the axial location of the packer 1660 and downhole therefrom). As shown in FIG. 16, the polished bore receptacle (PBR) 1620 can be operatively coupled to the packer 1660 (e.g., a tubular packer assembly).

While a PBR is mentioned, another type of polished joint may be utilized. A polished joint can be a completion component that has been polished or prepared to enable an efficient hydraulic seal. For example, a polished joint may include an internal or external polished surface and configured in a length that enables some movement of a completion string or associated components without compromising a hydraulic seal.

In the example of FIG. 16, various features, components, etc. are shown in an approximate cross-sectional view, noting that an axis z can be a longitudinal axis that may be associated with a cylindrical coordinate system. In the example of FIG. 16 (e.g., an in various other examples), the casing 1605 can be substantially cylindrical, the tubing 1610 can be substantially cylindrical, the PBR 1620 can be substantially cylindrical, etc.

As mentioned, the system 1600 can include an upper completion and a lower completion that can be run in hole (RIH) in a single trip (e.g., a single downhole trip; "tripping downhole"). Such a trip may be performed utilizing surface equipment, which can be or include a rig.

Figure 17:
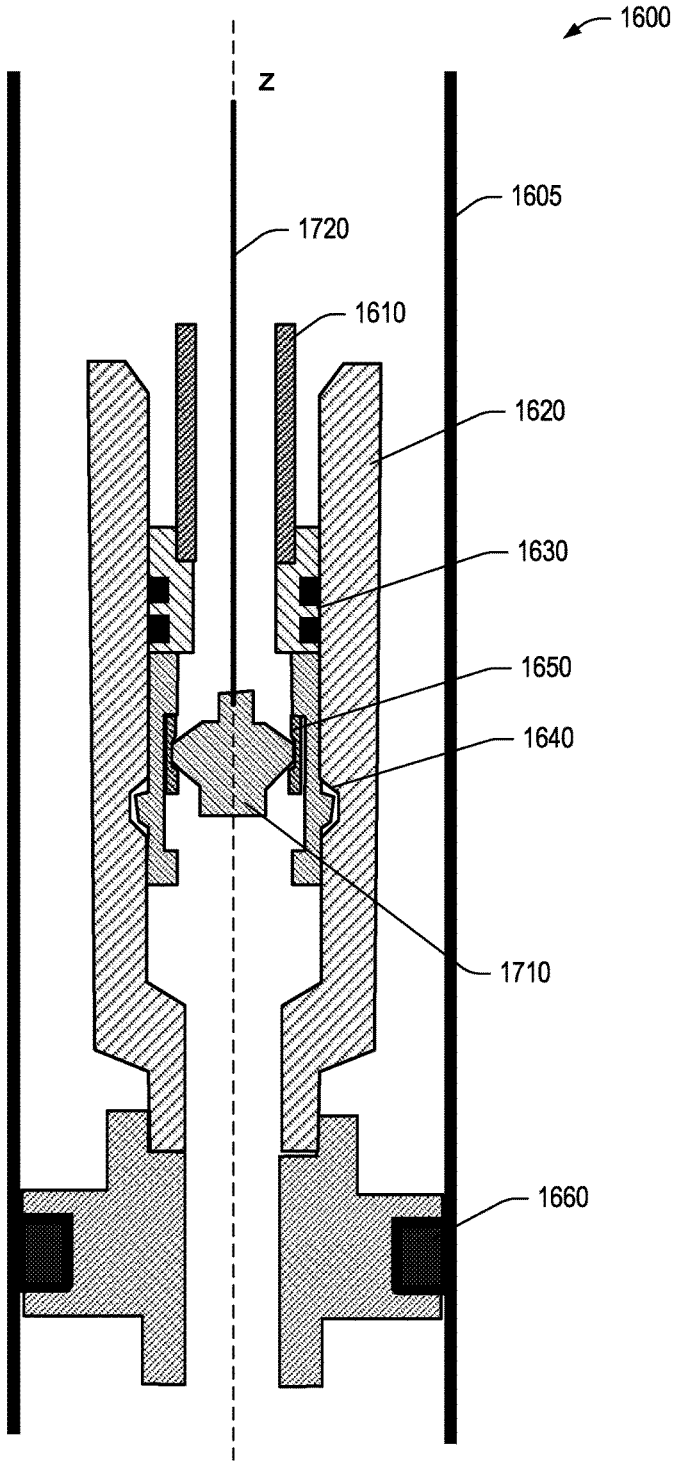
FIG. 17 shows at least a portion of the system of FIG. 16 in a second state.

FIG. 17 shows the system 1600 of FIG. 16 where a shifting tool 1710 is deployed substantially along the z axis to align with the collet support sleeve 1650. In such an example, a method can include running the shifting tool 1710 on a slick line 1720 to an axial position that can shift the collet support sleeve 1650. As shown in FIG. 17, the collet support sleeve 1650 is shifted axially upwardly via the shifting tool 1710 as supported by the slick line 1720.

Figure 18:
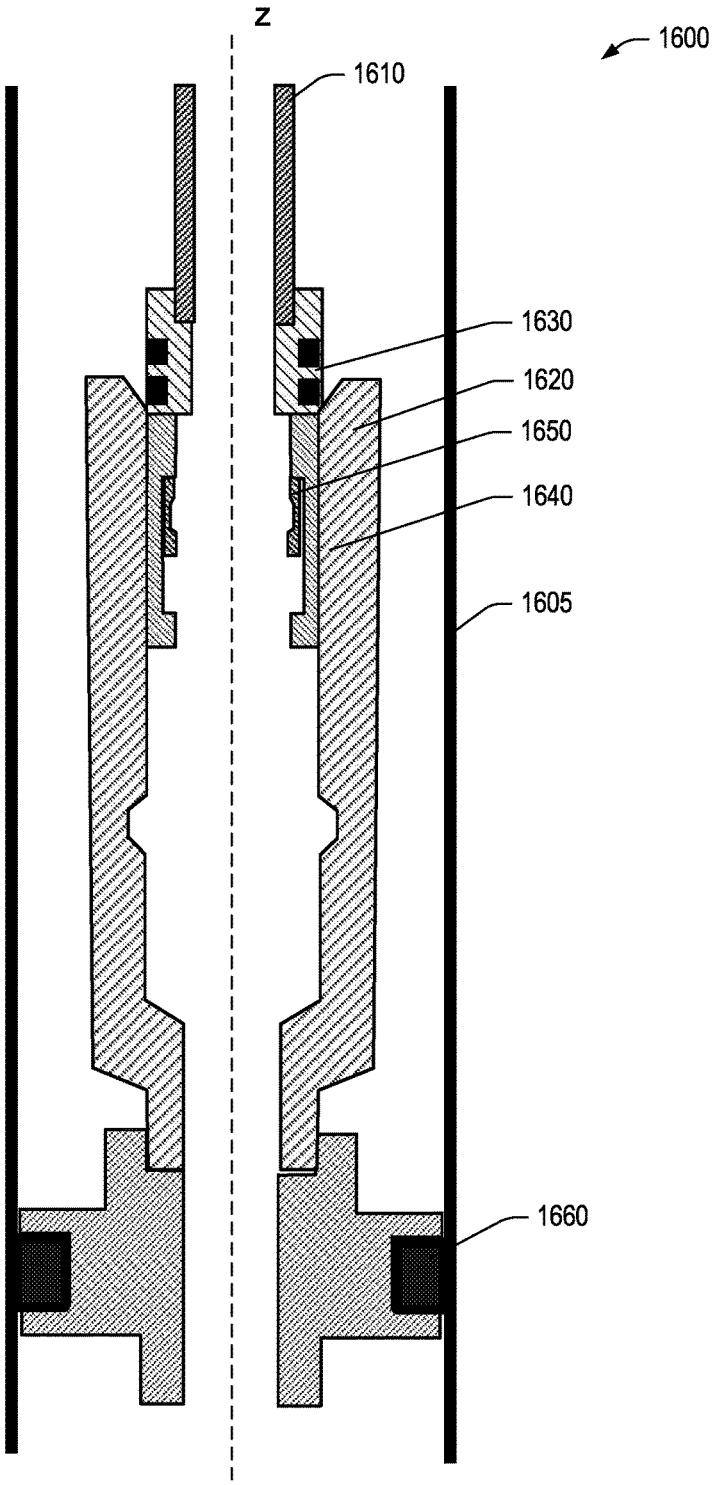
FIG. 18 shows at least a portion of the system of FIG. 16 in a third state.

FIG. 18 shows the system 1600 of FIG. 16 where the collet latch 1640 has been shifted further uphole by the shifting tool 1710, which has been retrieved. In such an example, the collet latch 1640 can be translatable in the polished bore receptacle (PBR) 1620 such that the tubing 1610 may be pulled out of hole (e.g., the upper completion can be pulled out of hole (POOH)).

Figure 19:
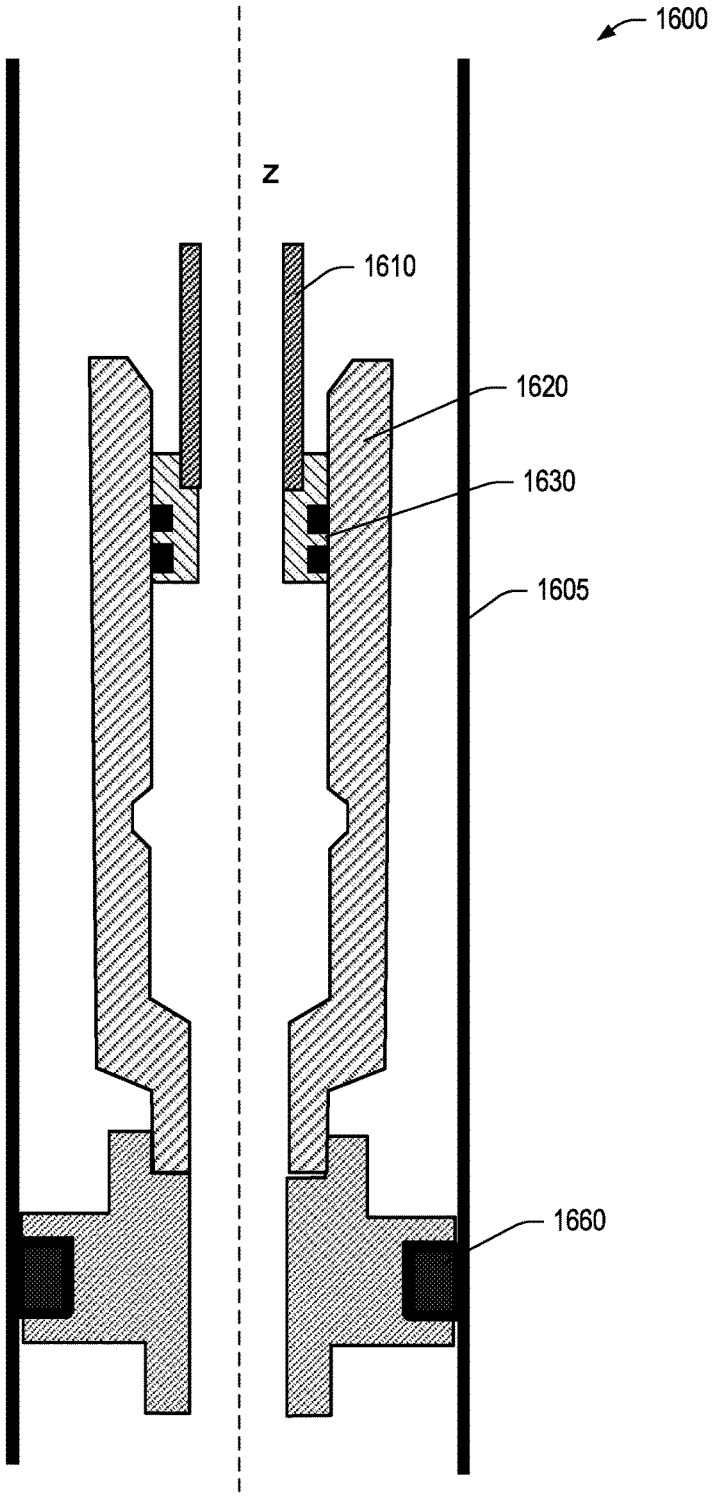
FIG. 19 shows at least a portion of the system of FIG. 16 in a fourth state.

FIG. 19 shows the system 1600 of FIG. 16 where the production tubing 1610 may be run back in hole along with the seal assembly 1630 and without the collet components 1640 and 1650. In such an example, the upper completion including the production tubing 1610 and the seal assembly 1630 can be received by the PBR 1620 to form a hydraulically sealed joint that allows for communication of fluid of a tubing bore of the lower completion and a tubing bore of the PBR 1620 and the production tubing 1610.

The equipment illustrated in FIGS. 16, 17, 18 and 19 may be part of a workflow or workflows that implement a shift to unlock (e.g., shift to unlatch, shift to disconnect, etc.) mechanism as to a lower completion and an upper completion, which may at an initial stage be run in hole (RIH) in a single trip (e.g., prior to unlocking, unlatching, disconnecting, etc.).

As mentioned, a method can include utilizing absolute tubing pressure to unlock a lower completion and an upper completion. In such an example, a lower completion may have established therein one or more mechanical barriers to flow. For example, a lower completion may include at least two mechanical barriers to flow in a bore of the lower completion.

Figure 20:
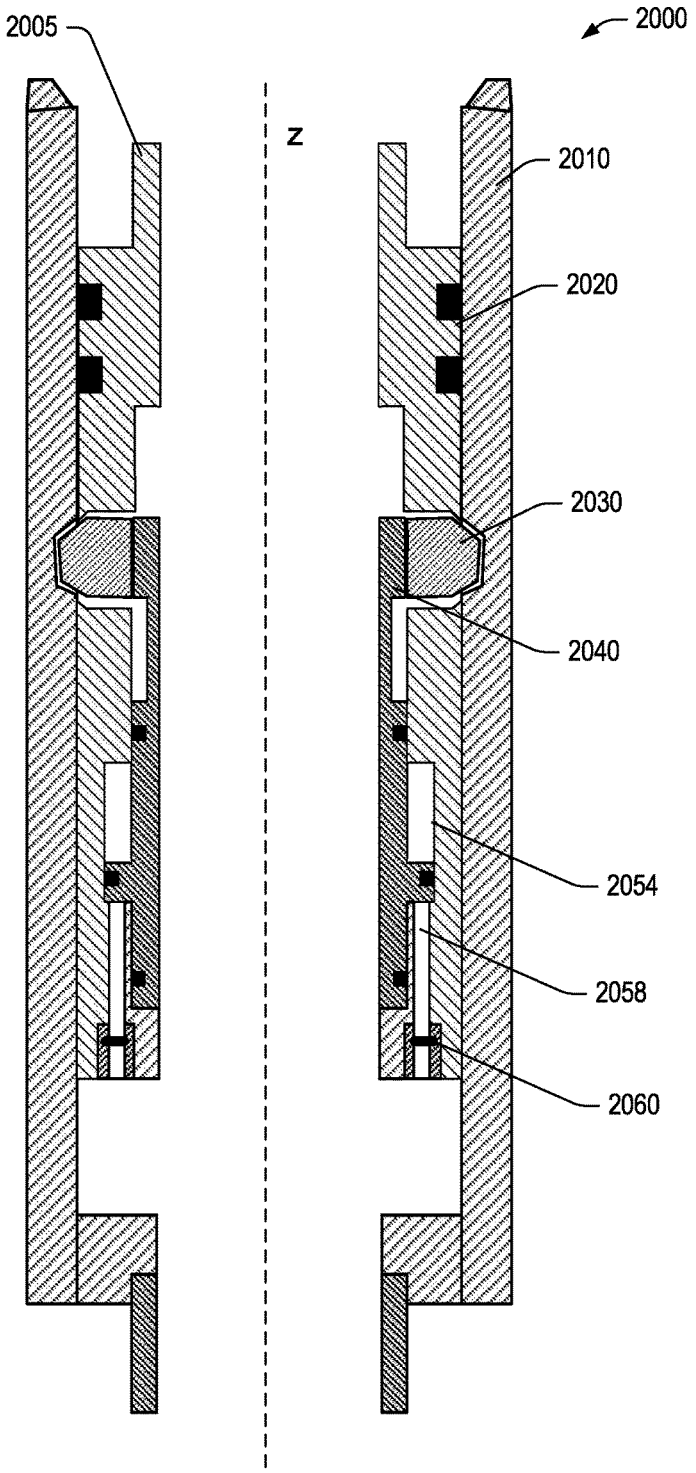
FIG. 20 shows an example of a system that includes an upper completion and a lower completion in a first state.

FIG. 20 shows an example of a system 2000 that includes a tubing 2005, a polished bore receptacle (PBR) 2010, a seal assembly 2020, locking dogs 2030, a locking dogs support sleeve 2040, atmospheric chambers 2054 and 2058 and a rupture disc or rupture discs 2060.

In the example of FIG. 20, the system 2000 can provide for unlocking via an absolute tubing pressure actuated hydraulic unlock mechanism. As an example, the system 2000 may be run in hole (RIH) locked in mid-position.

Figure 21:
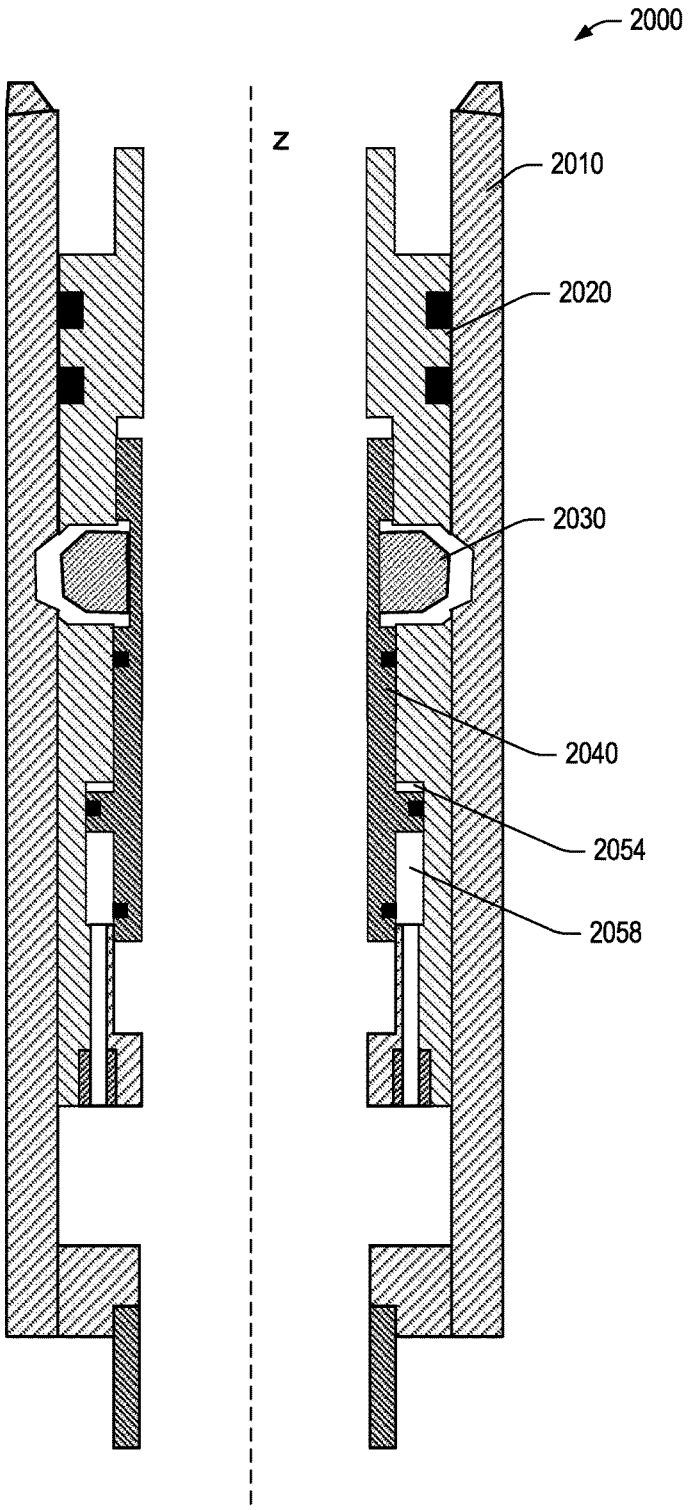
FIG. 21 shows at least a portion of the system of FIG. 20 in a second state.

FIG. 21 shows the system 2000 of FIG. 20 with the rupture disc(s) 2060 burst. In the example of FIG. 21, the locking dogs support sleeve 2040 can be moved axially to an unsupported position due to pressure actuation as the atmospheric chamber 2058 is in fluid communication with the tubing bore. As shown in FIG. 21, with the locking dogs support sleeve 2040 translated axially in an uphole direction the locking dogs 2030 can move radially inwardly such that they disengage from the polished bore receptacle (PBR) 2010 (e.g., disengage from latching features of the PBR 2010).

In the example of FIG. 21, as the locking dogs 2030 are in a disengaged state as received by the locking dogs support sleeve 2040, the tubing 2005 can translate axially upward or downwardly. In such an example, the tubing 2005 may be movable in one of two axial directions with respect to the z axis. In the example of FIG. 21, the PBR 2010 (e.g., or other polished joint or joint, etc.) may be part of a lower completion of the system 2000 while the tubing 2005 may be part of an upper completion of the system 2000.

Figure 22:
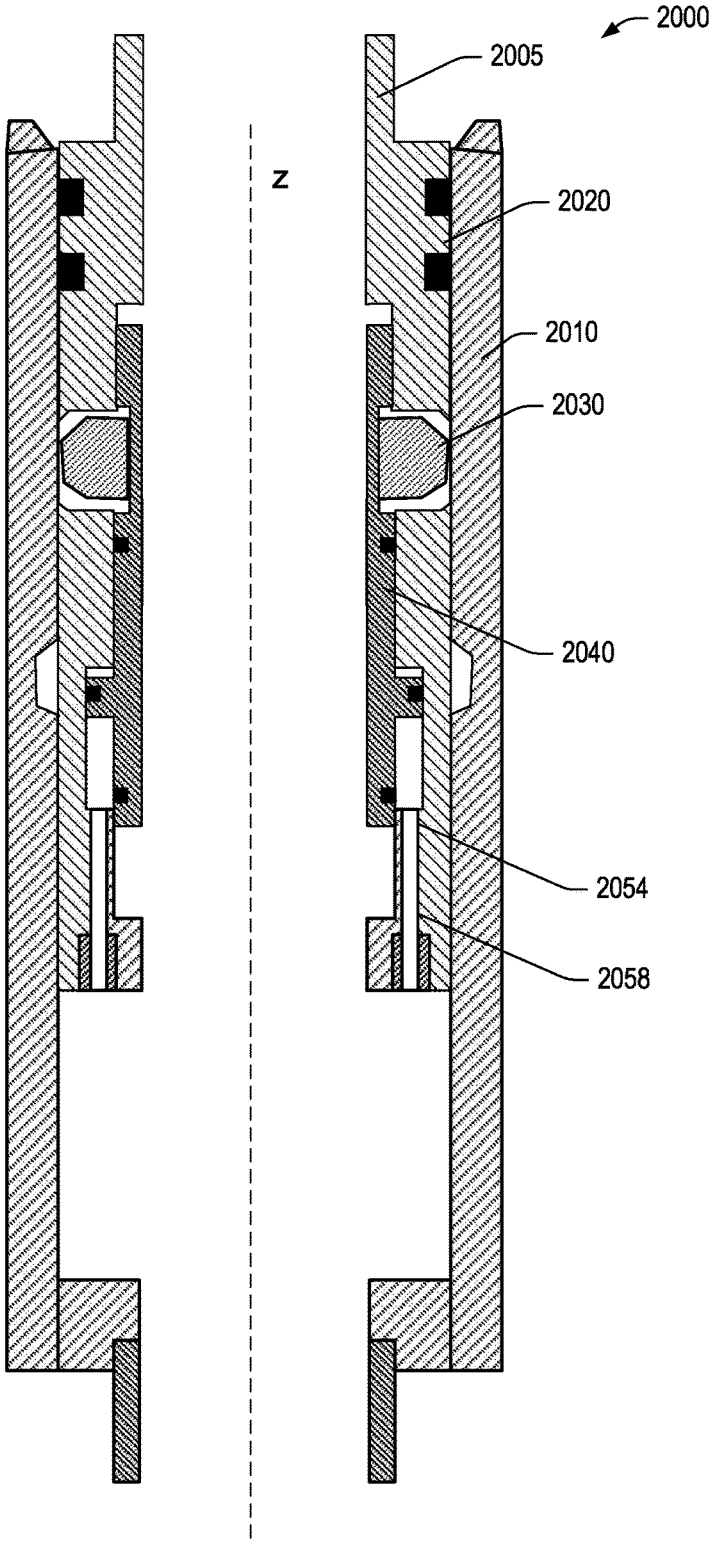
FIG. 22 shows at least a portion of the system of FIG. 20 in a third state.

FIG. 22 shows the system 2000 where the locking dogs 2030 are unlocked from the PBR 2010 such that the tubing 2005 can be translated axially upwardly to be pulled out of hole (POOH).

Figure 23:
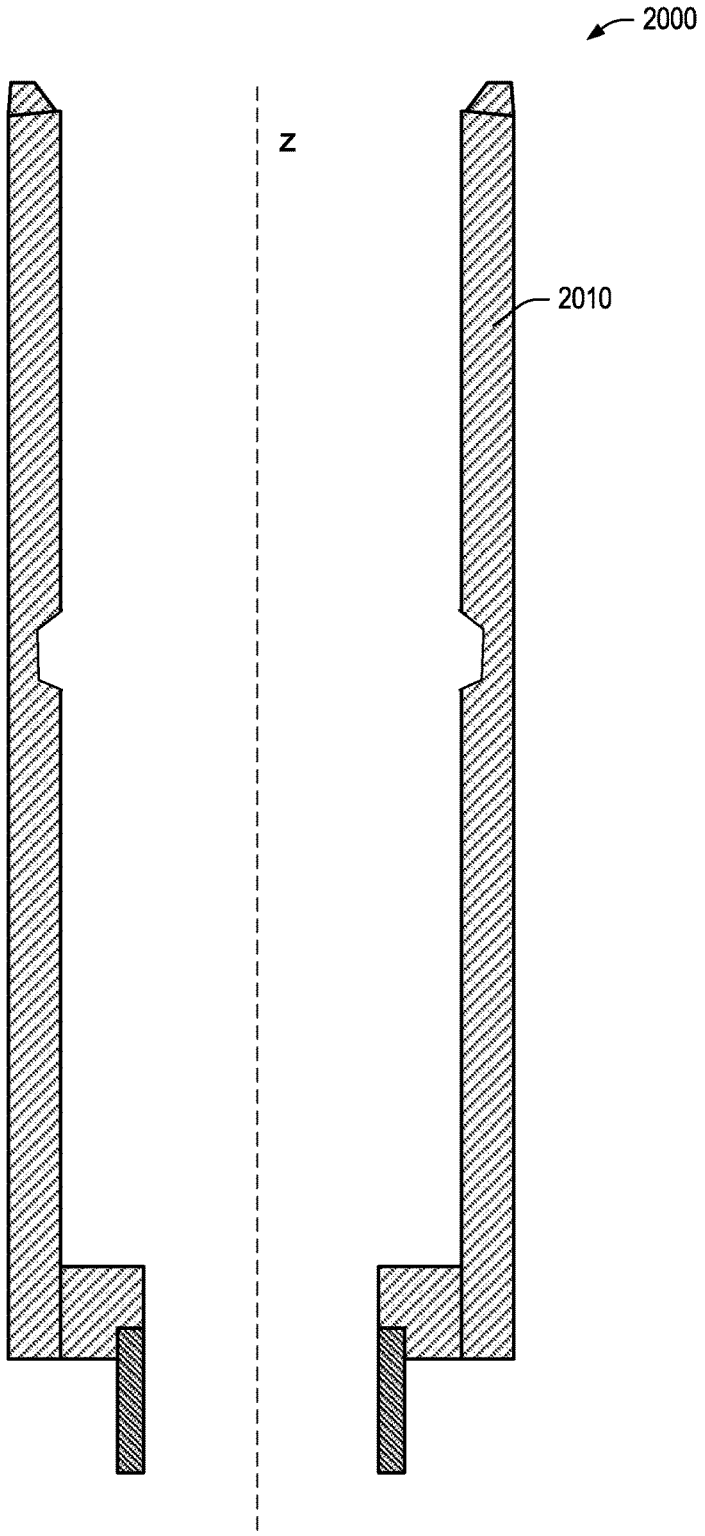
FIG. 23 shows at least a portion of the system of FIG. 20 in a fourth state.

FIG. 23 shows the PBR 2010 without the tubing 2005 and associated components. In such an example, the PBR 2010 can be part of a lower completion that is run in hole together with an upper completion in a single trip where, for example, after establishing one or more mechanical fluid barriers in the lower completion, the upper completion may be unlocked (e.g., unlatched, disconnected, etc.) such that the upper completion (e.g., as optionally modified, etc.) and/or another upper completion may be run in hole (RIH) and operatively coupled to the lower completion via the PBR 2010 (e.g., or another type of joint that may be part of a lower completion).

Figure 24:
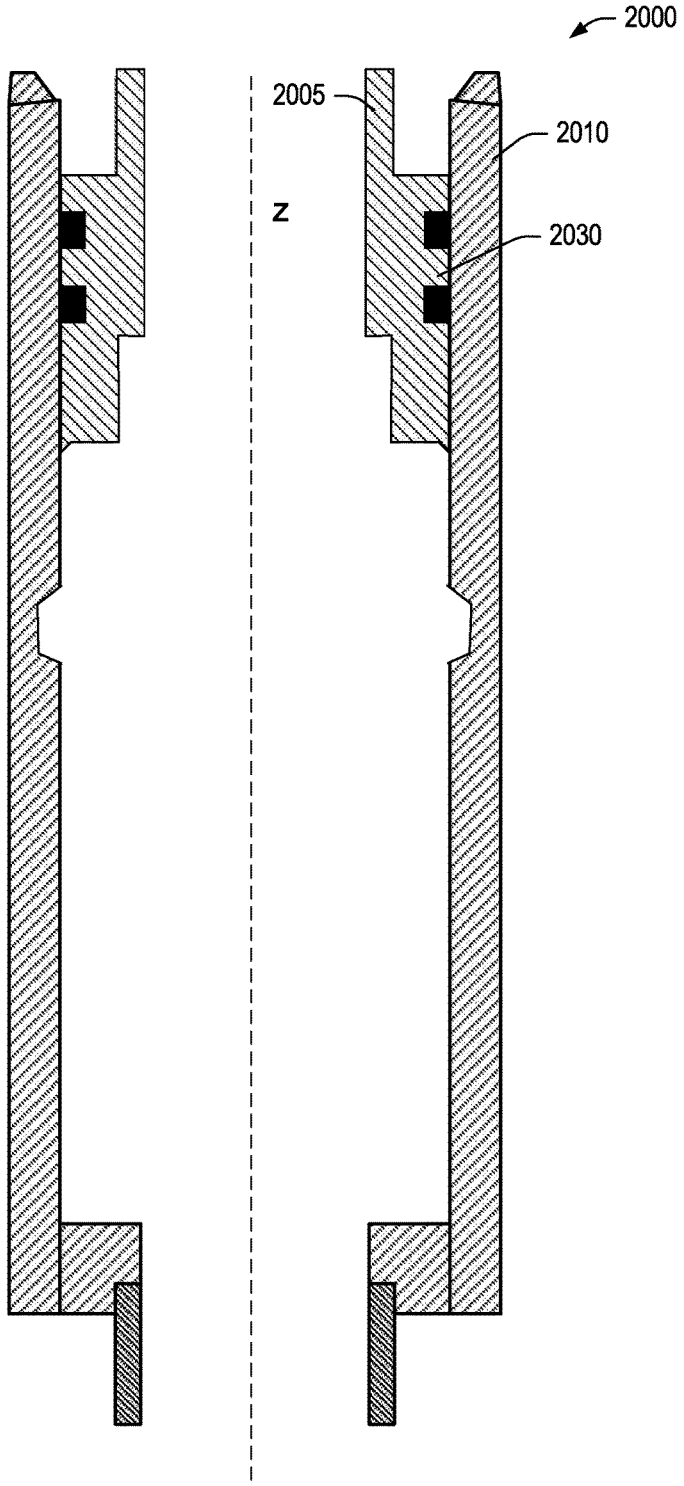
FIG. 24 shows at least a portion of the system of FIG. 20 in a fifth state.

FIG. 24 shows the system 2000 without various components and with the PBR 2010 and the tubing 2005 and the seal assembly 2030, which forms a hydraulic seal with an inner surface (e.g., bore surface) of the PBR 2010.

The equipment illustrated in FIGS. 20, 21, 22, 23 and 24 may be part of a workflow or workflows that implement a fluid pressure to unlock (e.g., fluid pressure to unlatch, fluid pressure to disconnect, etc.) mechanism as to a lower completion and an upper completion, which may at an initial stage be run in hole (RIH) in a single trip (e.g., prior to unlocking, unlatching, disconnecting, etc.). In such an example, one or more mechanical fluid barriers may be established in a lower completion, which may be opened for purposes of flowing fluid, for example, from a formation to a tubing bore.

Figure 25:
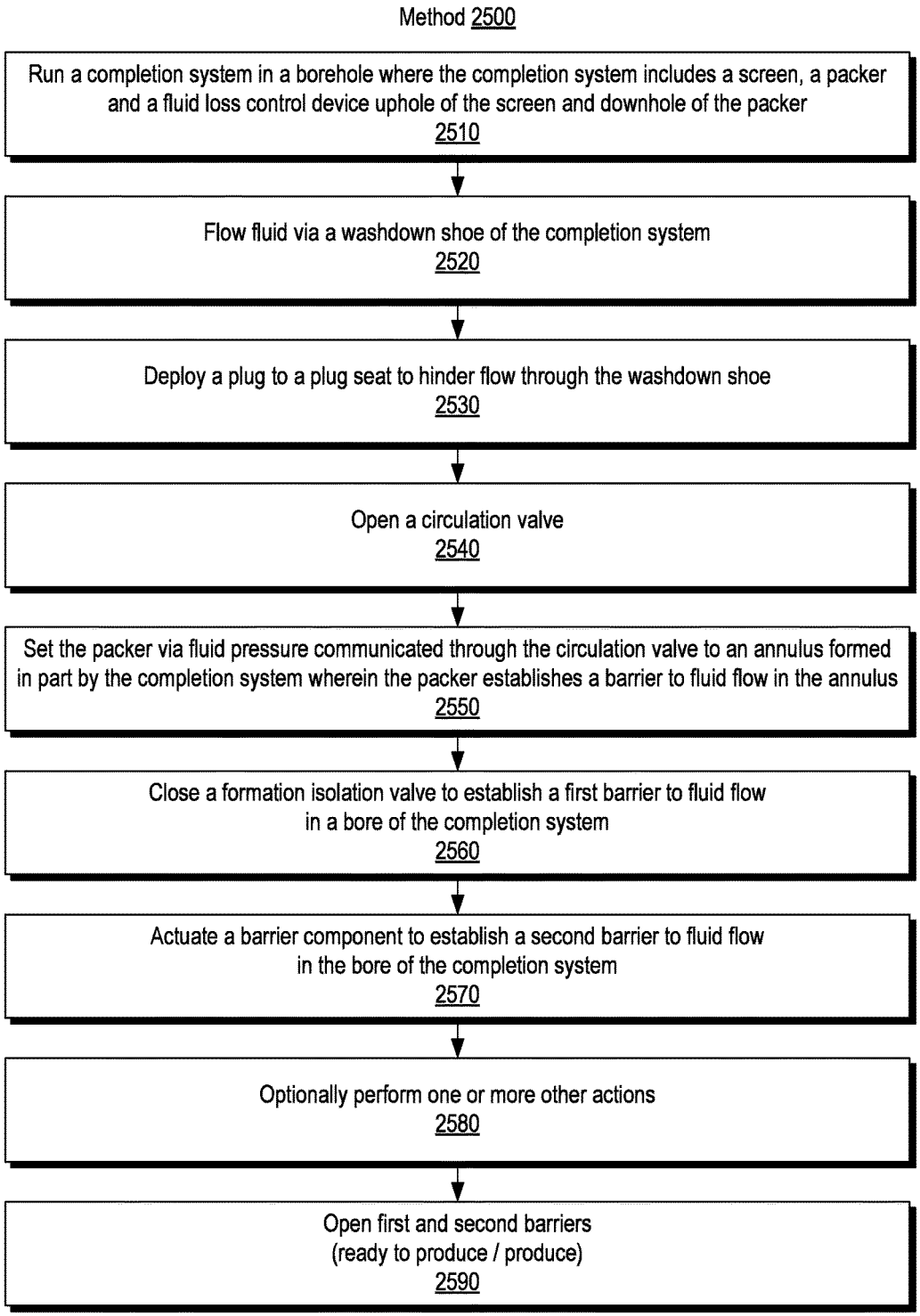
FIG. 25 shows an example of a method.

FIG. 25 shows an example of a method 2500 that includes a run block 2510 for running a completion system in a borehole where the completion system includes a screen, a packer and a fluid loss control device uphole of the screen and downhole of the packer; a flow block 2520 for flowing fluid via a washdown shoe of the completion system; a deployment block 2530 for deploying a plug to a plug seat to hinder flow through the washdown shoe; an open block 2540 for opening a circulation valve; a set block 2550 for setting the packer via fluid pressure communicated through the circulation valve to an annulus formed in part by the completion system where the packer establishes a barrier to fluid flow in the annulus; a close block 2560 for closing a formation isolation valve to establish a first barrier to fluid flow in a bore of the completion system; and an actuation block 2570 for actuating a barrier component to establish a second barrier to fluid flow in the bore of the completion system.

As shown, the method 2500 can include an optional performance block 2580 for performing one or more other actions such as, for example, a disconnecting action, a reconnecting action, etc. For example, a completion system may include an upper completion and a lower completion that are joined at a joint where one or more mechanisms can allow for unlatching of the upper completion from the lower completion such that, for example, the upper completion may be translated in a borehole (e.g., optionally pulled out of hole (POOH)). As an example, an action can include running an upper completion in a borehole and connecting the upper completion to the lower completion. In such an example, where two barriers are established as to hinder flow in the lower completion, the barriers may be opened to permit flow where a portion of the flow can be from the lower completion to the upper completion or vice versa.

In the example of FIG. 25, the method 2500 can establish at least one flow barrier in an annulus (e.g., via the packer, etc.) and at least one flow barrier in a bore (e.g., via the formation isolation valve and/or the barrier component, which may be a safety valve or another type of barrier component such as a nipple profile that can receive a plug, etc.).

In the example of FIG. 25, the method 2500 includes an open block 2590 for opening the bore barriers, which may be opened to permit flow of fluid in the bore of the completion system.

As mentioned, the method 2500 can include opening the first barrier and the second barrier. In such an example, the method 2500 can include flowing fluid in the bore of the completion system where at least a portion of the fluid flows via the screen of the completion system.

As an example, the method 2500 can include disconnecting an upper portion of the completion system from a lower portion of the completion system. In such an example, the method 2500 may include translating the upper portion of the completion system with respect to the lower portion of the completion system.

As an example, the method 2500 can include performing the opening, the closing or the opening and the closing via applying fluid pressure, discharging a charge, or applying fluid pressure and discharging a charge (e.g., closing via applying fluid pressure and opening via discharging a charge or closing via discharging a charge and opening via applying fluid pressure).

As an example, a completion assembly (e.g., or a completion system) can include tubing that defines an axis that extends from a distal shoe end to a proximal uphole end where the tubing includes: a washdown shoe that permits flow from an interior space defined by the tubing to an exterior space; a plug seat configured to receive a plug that hinders flow through the washdown shoe; a screen that permits flow from the exterior space to the interior space; a fluid loss control device that permits, in the exterior space, flow of fluid in an uphole direction and that hinders flow of fluid in a downhole direction; a circulation valve that is actuatable to permit flow of fluid from the interior space to the exterior space; a formation isolation valve that is actuatable to form a flow barrier in the interior space; a packer that is actuatable to extend radially outwardly from the tubing to form an annular flow barrier in the exterior space; and a barrier component that is actuatable to form a flow barrier in the interior space of the tubing.

As an example, a circulation valve may be pressure actuatable. As an example, a formation isolation valve may be pressure actuatable. For example, such a formation isolation valve can include a rupture disc actuatable to close the valve and a gas spring actuatable to open the valve. As an example, a formation isolation valve can include an explosive charge.

As an example, a completion assembly (e.g., or completion system) can include a hydrostatically actuatable mechanism that is actuatable to set a packer.

As an example, a completion assembly (e.g., or completion system) can include a plug configured for receipt by a plug seat.

As an example, a completion assembly (e.g., or a completion system) can include tubing with an upper portion and a lower portion where the upper portion is detachable from the lower portion. In such an example, the lower portion can include a polished joint and, for example, the upper portion can be unlatchable from the polished joint via a tubing pressure actuatable mechanism or, for example, via a shifting mechanism.

As an example, a completion assembly (e.g., or a completion system) can include a dual valve subassembly that includes a circulation valve and a formation isolation valve.

As an example, a completion assembly (e.g., or a completion system) can include a barrier component that is or that includes a safety valve that is actuatable to form a flow barrier in a bore.

As an example, a completion assembly (e.g., or a completion system) can include a barrier component that includes a nipple profile that is actuatable via receipt of a nipple profile plug to form the flow barrier.

As an example, a completion assembly (e.g., or a completion system) can include, from a distal location to a proximal location, a washdown shoe, a plug seat, a screen, a fluid loss control device, a circulation valve, a formation isolation valve, a packer, and a barrier component.

As an example, a method may be implemented at least in part via one or more computing systems, controllers, etc. In such an example, instructions may be included and stored in a non-transitory storage medium that is not a carrier wave and that is not a signal. Such a non-transitory storage medium may be a computer-readable storage medium (CRM) and/or a processor-readable storage medium. Such a medium or media can be operatively coupled to one or more processors, microcontrollers, etc. such that instructions may be accessed and executed to cause a system to perform one or more actions. As an example, an action may be pressure related, mechanically related, etc. As an example, one or more methods associated with establishing a barrier or barriers to flow in a lower completion may be implemented at least in part via a computing system, which may be part of a surface system located at a wellsite.

As an example, one or more methods described herein may include associated computer-readable storage media (CRM) blocks. Such blocks can include instructions suitable for execution by one or more processors (or cores) to instruct a computing device or system to perform one or more actions.

According to an embodiment, one or more computer-readable media may include computer-executable instructions to instruct a computing system to output information for controlling a process. For example, such instructions may provide for output to as to one or more of a sensing process, an injection process, a drilling process, a completion process, an extraction process, a pumping process, etc.

Figure 26:
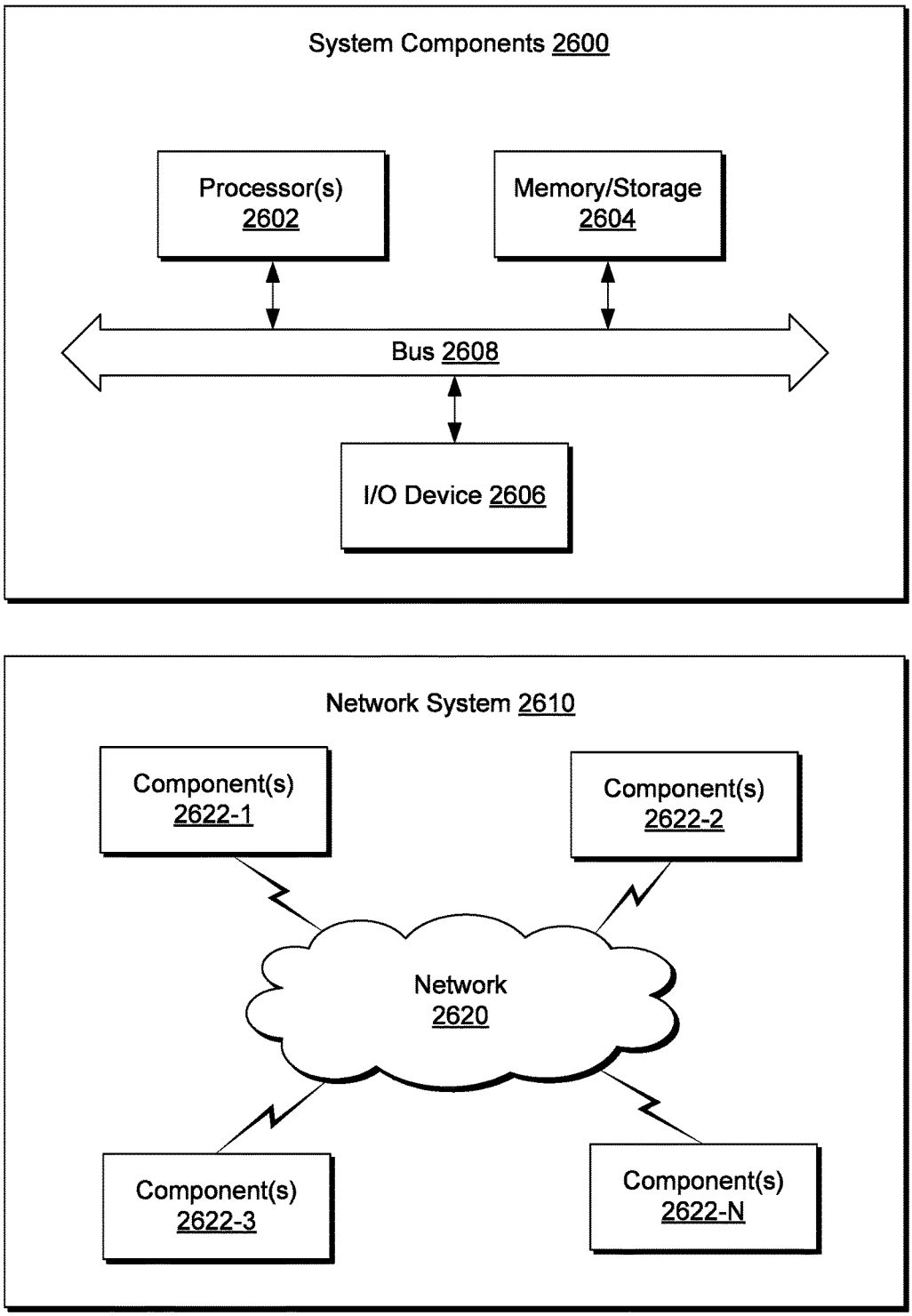
FIG. 26 illustrates example components of a system and a networked system.

FIG. 26 shows components of a computing system 2600 and a networked system 2610. The system 2600 includes one or more processors 2602, memory and/or storage components 2604, one or more input and/or output devices 2606 and a bus 2608. According to an embodiment, instructions may be stored in one or more computer-readable media (e.g., memory/storage components 2604). Such instructions may be read by one or more processors (e.g., the processor(s) 2602) via a communication bus (e.g., the bus 2608), which may be wired or wireless. The one or more processors may execute such instructions to implement (wholly or in part) one or more attributes (e.g., as part of a method). A user may view output from and interact with a process via an I/O device (e.g., the device 2606). According to an embodiment, a computer-readable medium may be a storage component such as a physical memory storage device, for example, a chip, a chip on a package, a memory card, etc.

According to an embodiment, components may be distributed, such as in the network system 2610. The network system 2610 includes components 2622-1, 2622-2, 2622-3, . . . 2622-N. For example, the components 2622-1 may include the processor(s) 2602 while the component(s) 2622-3 may include memory accessible by the processor(s) 2602. Further, the component(s) 2622-2 may include an I/O device for display and optionally interaction with a method. The network may be or include the Internet, an intranet, a cellular network, a satellite network, etc.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A completion assembly comprising:

tubing that defines an axis that extends from a distal shoe end to a proximal uphole end wherein the tubing comprises:

a washdown shoe that permits flow from an interior space defined by the tubing to an exterior space;

a plug seat configured to receive a plug that hinders flow through the washdown shoe;

a screen that permits flow from the exterior space to the interior space;

a fluid loss control device that permits, in the exterior space, flow of fluid in an uphole direction and that hinders flow of fluid in a downhole direction;

a circulation valve that is actuatable to permit flow of fluid from the interior space to the exterior space;

a formation isolation valve that is actuatable to form a flow barrier in the interior space;

a packer that is actuatable to extend radially outwardly from the tubing to form an annular flow barrier in the exterior space; and a barrier component that is actuatable to form a flow barrier in the interior space of the tubing, wherein the formation isolation valve is pressure actuatable, and wherein the formation isolation valve is uphole of the fluid loss control device and downhole of the packer.

2. The completion assembly of claim 1 wherein the circulation valve is pressure actuatable.

3. The completion assembly of claim 1 wherein the formation isolation valve comprises a rupture disc actuatable to close the valve and a gas spring actuatable to open the valve.

4. The completion assembly of claim 1 wherein the formation isolation valve comprises an explosive charge.

5. The completion assembly of claim 1 comprising a hydrostatically actuatable mechanism that is actuatable to set the packer.

6. The completion assembly of claim 1 comprising a plug configured for receipt by the plug seat.

7. The completion assembly of claim 1 wherein the tubing comprises an upper portion and a lower portion wherein the upper portion is detachable from the lower portion.

8. The completion assembly of claim 7 wherein the lower portion comprises a polished joint.

9. The completion assembly of claim 7 wherein the upper portion is unlatchable from the polished joint via a tubing pressure actuatable mechanism.

10. The completion assembly of claim 1 comprising a dual valve subassembly that comprises the circulation valve and the formation isolation valve.

11. The completion assembly of claim 1 wherein the barrier component comprises a safety valve that is actuatable to form the flow barrier.

12. The completion assembly of claim 1 wherein the barrier component comprises a nipple profile that is actuatable via receipt of a nipple profile plug to form the flow barrier.

13. The completion assembly of claim 1 wherein, from a distal downhole location to a proximal uphole location, the completion assembly comprises the washdown shoe, the plug seat, the screen, the fluid loss control device, the circulation valve, the formation isolation valve, the packer, and the barrier component, and wherein the distal downhole location and the proximal uphole location are relative to a ground surface.

14. A method comprising:

running a completion system in a borehole wherein the completion system comprises a screen, a packer and a fluid loss control device uphole of the screen and downhole of the packer;

flowing fluid via a washdown shoe of the completion system;

deploying a plug to a plug seat to hinder flow through the washdown shoe;

opening a circulation valve;

setting the packer via fluid pressure communicated through the circulation valve to an annulus formed in part by the completion system wherein the packer establishes a barrier to fluid flow in the annulus;

closing a formation isolation valve to establish a first barrier to fluid flow in a bore of the completion system, wherein the formation isolation valve is pressure actuatable, wherein the formation isolation valve is uphole of the fluid loss control device and downhole of the packer; and actuating a barrier component to establish a second barrier to fluid flow in the bore of the completion system.

15. The method of claim 14 comprising opening the first barrier and the second barrier.

16. The method of claim 15 comprising flowing fluid in the bore of the completion system wherein at least a portion of the fluid flows via the screen of the completion system.

17. The method of claim 14 comprising disconnecting an upper portion of the completion system from a lower portion of the completion system.

18. The method of claim 17 comprising translating the upper portion of the completion system with respect to the lower portion of the completion system.

19. The method of claim 14 wherein the opening, the closing or the opening and the closing are performed via applying fluid pressure, discharging a charge, or applying fluid pressure and discharging a charge.

* * * * *